US011180701B2

(12) United States Patent
Koseoglu et al.

(10) Patent No.: US 11,180,701 B2
(45) Date of Patent: Nov. 23, 2021

(54) HYDROCRACKING PROCESS AND SYSTEM INCLUDING SEPARATION OF HEAVY POLY NUCLEAR AROMATICS FROM RECYCLE BY EXTRACTION

(71) Applicant: Saudi Arabian Oil Company, Dhahran (SA)

(72) Inventors: Omer Refa Koseoglu, Dhahran (SA); Adnan Al-Hajji, Dammam (SA); Hendrik Muller, Dhahran (SA); Nadrah Al-Awani, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/530,408

(22) Filed: Aug. 2, 2019

(65) Prior Publication Data

US 2021/0032546 A1 Feb. 4, 2021

(51) Int. Cl.
*C10G 21/14* (2006.01)
*C10G 67/04* (2006.01)

(52) U.S. Cl.
CPC ..... *C10G 21/14* (2013.01); *C10G 67/04* (2013.01); *C10G 2300/201* (2013.01); *C10G 2300/4081* (2013.01)

(58) Field of Classification Search
None
See application file for complete search history.

(56) References Cited

U.S. PATENT DOCUMENTS 2,937,135 A 5/1960 Middleton
3,549,517 A 12/1970 Lehman et al.
(Continued)

FOREIGN PATENT DOCUMENTS

EP 0403087 A1 12/1990
EP 2930225 A1 10/2015
(Continued)

OTHER PUBLICATIONS

Sami H. Ali et al., Solubility of polycyclic aromatics in binary solvent mixtures using activity coefficient models, Fluid Phase Equilibria, vol. 230, Issues 1-2, Mar. 2005, pp. 176-183.
(Continued)

*Primary Examiner* — Tam M Nguyen
(74) *Attorney, Agent, or Firm* — Abelman, Frayne & Schwab

(57) ABSTRACT

Hydrocracked bottoms fractions are treated to separate HPNA compounds and/or HPNA precursor compounds and produce a reduced-HPNA hydrocracked bottoms fraction effective for recycle, in a configuration of a single-stage hydrocracking reactor, series-flow once through hydrocracking operation, or two-stage hydrocracking operation. A process for separation of HPNA and/or HPNA precursor compounds from a hydrocracked bottoms fraction of a hydroprocessing reaction effluent comprises contacting the hydrocracked bottoms fraction with an effective quantity of a non-polar solvent to promote precipitation of HPNA compounds and/or HPNA precursor compounds. The soluble hydrocarbons in the hydrocracked bottoms fraction are separated into an HPNA-reduced hydrocracked bottoms portion that is recycled within hydrocracking operations.

15 Claims, 8 Drawing Sheets

(56) References Cited

U.S. PATENT DOCUMENTS

| | | | | |
|---|---|---|---|---|
| 3,905,892 | A | 9/1975 | Gregoli et al. | |
| 4,447,315 | A | 5/1984 | Lamb et al. | |
| 4,591,426 | A | 5/1986 | Krasuk et al. | |
| 4,640,762 | A | 2/1987 | Woods et al. | |
| 4,655,903 | A | 4/1987 | Rahbe et al. | |
| 4,891,322 | A * | 1/1990 | Blackburn | C12Q 1/025 436/110 |
| 5,232,577 | A | 3/1993 | Fetzer et al. | |
| 8,828,219 | B2 * | 9/2014 | Koseoglu | C10G 67/06 208/91 |
| 2009/0120842 | A1 * | 5/2009 | Koseoglu | C10G 25/003 208/250 |
| 2010/0243518 | A1 | 9/2010 | Zimmerman et al. | |
| 2012/0187027 | A1 * | 7/2012 | Koseoglu | C10G 67/06 208/91 |
| 2016/0097006 | A1 | 4/2016 | Macris | |
| 2016/0115403 | A1 * | 4/2016 | Macris | C10G 67/049 208/59 |
| 2017/0369796 | A1 * | 12/2017 | Le Coz | C10G 65/12 |
| 2018/0187100 | A1 * | 7/2018 | Koseoglu | C10G 53/04 |
| 2019/0194553 | A1 | 6/2019 | Sun et al. | |
| 2020/0181509 | A1 * | 6/2020 | Brown | C10G 47/00 |
| 2020/0216765 | A1 * | 7/2020 | Guillon | C10G 65/12 |

FOREIGN PATENT DOCUMENTS

| | | | |
|---|---|---|---|
| RU | 2203306 | C2 | 4/2003 |
| WO | 2008014948 | A1 | 2/2008 |

OTHER PUBLICATIONS

E. V. Lau et al., Extraction Techniques for Polycyclic Aromatic Hydrocarbons in Soils, International Journal of Analytical Chemistry, vol. 2010 (2010), Article ID 398381, 9 p.

X. Dupain, et al., "Cracking behavior of organic sulfur compounds under realistic FCC conditions in a microriser reactor," Applied Catalysis A: General, vol. 238, pp. 223-238 (2008).

Teh Fu Yen, et al., "Investigation of the Structure of Petroleum Asphaltenes by X-Ray Diffraction," Analytical Chemistry, vol. 33, No. 11, 1587-11594 (Oct. 1961).

Msaoumeh Mousavi, et al., "Non-Covalent π-Stacking Interactions between Asphaltene and Porphyrin in Bitumen," Journal of Chemical Information and Modeling, No. 60, pp. 4856-4866 (2020).

PCT International Search Report and Written Opinion dated Oct. 9, 2020.

* cited by examiner

HYDROCRACKING PROCESS AND SYSTEM INCLUDING SEPARATION OF HEAVY POLY NUCLEAR AROMATICS FROM RECYCLE BY EXTRACTION

RELATED APPLICATIONS

Not applicable.

BACKGROUND OF THE INVENTION

Field of the Invention

The present invention relates to hydrocracking processes, and in particular to hydrocracking processes including separation of heavy poly nuclear aromatics from recycle streams using extraction with non-polar solvents.

Description of Related Art

Hydrocracking processes are used commercially in a large number of petroleum refineries. They are used to process a variety of feeds boiling within in the range of about 370-520° C. in conventional hydrocracking units and boiling at 520° C. and above in residue hydrocracking units. In general, hydrocracking processes split the molecules of the feed into smaller, i.e., lighter, molecules having higher average volatility and economic value. Additionally, hydrocracking processes typically improve the quality of the hydrocarbon feedstock by increasing the hydrogen-to-carbon ratio and by removing organosulfur and organonitrogen compounds. The significant economic benefit derived from hydrocracking processes has resulted in substantial development of process improvements and more active catalysts.

In addition to sulfur-containing and nitrogen-containing compounds, a typical hydrocracking feedstream such as vacuum gas oil (VGO), contains a small amount of poly nuclear aromatic (PNA) compounds, i.e., those containing less than seven fused aromatic rings. As the feedstream is subjected to hydroprocessing at elevated temperature and pressure, heavy poly nuclear aromatic (HPNA) compounds, i.e., those containing seven or more fused benzene rings, tend to form and are present in high concentration in the unconverted hydrocracker bottoms.

Heavy feedstreams such as demetallized oil (DMO) or deasphalted oil (DAO) have much higher concentrations of nitrogen, sulfur and PNA compounds than VGO feedstreams. These impurities can lower the overall efficiency of hydrocracking units by requiring higher operating temperature, higher hydrogen partial pressure or additional reactor/catalyst volume. In addition, high concentrations of impurities can accelerate catalyst deactivation.

Three major hydrocracking process schemes include single-stage once through hydrocracking, series-flow hydrocracking with or without recycle, and two-stage recycle hydrocracking. Single-stage once through hydrocracking is the simplest of the hydrocracker configurations and typically occurs at operating conditions that are more severe than hydrotreating processes, and less severe than conventional full-pressure hydrocracking processes. It uses one or more reactors for both the treating steps and the cracking reaction, so the catalyst must be capable of both hydrotreating and hydrocracking. This configuration is cost effective, but typically results in relatively low product yields (for example, a maximum conversion rate of about 60%). Single-stage hydrocracking is often designed to maximize mid-distillate yield over single or dual catalyst systems. Dual catalyst systems can be used in a stacked-bed configuration or in two different reactors. The effluents are passed to a fractionator column to separate the $H_2S$, $NH_3$, light gases ($C_1$-$C_4$), naphtha and diesel products boiling in the temperature range of 36-370° C. The hydrocarbons boiling above 370° C. are typically unconverted bottoms that, in single stage systems, are passed to other refinery operations.

Series-flow hydrocracking with or without recycle is one of the most commonly used configurations. It uses one reactor (containing both treating and cracking catalysts) or two or more reactors for both treating and cracking reaction steps. In a series-flow configuration the entire hydrocracked product stream from the first reaction zone, including light gases (typically $C_1$-$C_4$, $H_2S$, $NH_3$) and all remaining hydrocarbons, are sent to the second reaction zone. Unconverted bottoms from the fractionator column are recycled back into the first reactor for further cracking. This configuration converts heavy crude oil fractions, i.e., vacuum gas oil, into light products and has the potential to maximize the yield of naphtha, jet fuel, or diesel, depending on the recycle cut point used in the distillation section.

Two-stage recycle hydrocracking uses two reactors and unconverted bottoms from the fractionation column are passed to the second reactor for further cracking. Since the first reactor accomplishes both hydrotreating and hydrocracking, the feed to second reactor is virtually free of ammonia and hydrogen sulfide. This permits the use of high-performance zeolite catalysts which are susceptible to poisoning by sulfur or nitrogen compounds.

A typical hydrocracking feedstock is vacuum gas oils boiling in the nominal range of 370-565° C. Heavier oil feedstreams such as DMO or DAO, alone or blended with vacuum gas oil, is processed in a hydrocracking unit. For instance, a typical hydrocracking unit processes vacuum gas oils that contain from 10V % to 25V % of DMO or DAO for optimum operation. A 100% DMO or DAO feed can also be processed, typically under more severe conditions, since the DMO or DAO stream contains significantly more nitrogen compounds (2,000 ppmw vs. 1,000 ppmw) and a higher micro carbon residue (MCR) content than the VGO stream (10 W % vs.<1 W %).

DMO or DAO content in blended feedstocks to a hydrocracking unit can lower the overall efficiency of the unit by increasing operating temperature or reactor/catalyst volume for existing units, or by increasing hydrogen partial pressure requirements or reactor/catalyst volume for grass-roots units. These impurities can also reduce the quality of the desired intermediate hydrocarbon products in the hydrocracking effluent. When DMO or DAO are processed in a hydrocracker, further processing of hydrocracking reactor effluents may be required to meet the refinery fuel specifications, depending upon the refinery configuration. When the hydrocracking unit is operating in its desired mode, that is to say, discharging a high quality effluent product stream, its effluent can be utilized in blending and to produce gasoline, kerosene and diesel fuel to meet established fuel specifications.

In addition, formation of HPNA compounds is an undesirable side reaction that occurs in recycle hydrocrackers. The HPNA molecules form by dehydrogenation of larger hydro-aromatic molecules or cyclization of side chains onto existing HPNA molecules followed by dehydrogenation, which is favored as the reaction temperature increases. HPNA formation depends on many known factors including the type of feedstock, catalyst selection, process configuration, and operating conditions. Since HPNA molecules accumulate in the recycle system and then cause equipment fouling, HPNA formation must be controlled in the hydrocracking process.

The rate of formation of the various HPNA compounds increases with higher conversion and heavier feed stocks. The fouling of equipment may not be apparent until large amounts of HPNA accumulate in the recycle liquid loop. The problem of HPNA formation is of universal concern to refiners and various removal methods have been developed by refinery operators to reduce its impact.

Conventional methods to separate or treat heavy poly-nuclear aromatics formed in the hydrocracking process include adsorption, hydrogenation, extraction, solvent deasphalting and purging, or "bleeding" a portion of the recycle stream from the system to reduce the build-up of HPNA compounds and cracking or utilizing the bleed stream elsewhere in the refinery. The hydrocracker bottoms are treated in separate units to eliminate the HPNA molecules and recycle HPNA-free bottoms back to the hydrocracking reactor.

As noted above, one alternative when operating the hydrocracking unit in the recycle mode is to purge a certain amount of the recycle liquid to reduce the concentration of HPNA that is introduced with the fresh feed, although purging reduces the conversion rate to below 100%. Another solution to the build-up problem is to eliminate the HPNAs by passing them to a special purpose vacuum column which effectively fractionates 98-99% of the recycle stream leaving most of the HPNAs at the bottom of the column for rejection from the system as fractionator bottoms. This alternative incurs the additional capital cost and operating expenses of a dedicated fractionation column.

The problem therefore exists of providing a process for removing HPNA compounds from the bottoms recycle stream of a hydrocracking unit that is more efficient and cost effective than the known processes.

SUMMARY OF THE INVENTION

Hydrocracked bottoms fractions are treated to separate HPNA compounds and/or HPNA precursor compounds and produce a reduced-HPNA hydrocracked bottoms fraction effective for recycle, in a configuration of a single-stage hydrocracking reactor, series-flow once through hydrocracking operation, or two-stage hydrocracking operation. A process for separation of HPNA and/or HPNA precursor compounds from a hydrocracked bottoms fraction of a hydroprocessing reaction effluent comprises contacting the hydrocracked bottoms fraction with an effective quantity of a non-polar solvent to promote precipitation of HPNA compounds and/or HPNA precursor compounds. The soluble hydrocarbons in the hydrocracked bottoms fraction are separated into an HPNA-reduced hydrocracked bottoms portion.

The above methods for separation of HPNA compounds and/or HPNA precursor compounds by non-polar solvent extraction can be integrated in a hydrocracking operation using a single reactor or plural reactors in a "once-through" configuration. Accordingly, in certain embodiments a hydrocracking process for treating a heavy hydrocarbon feedstream which contains undesired nitrogen-containing compounds and poly-nuclear aromatic compounds is provided that comprises subjecting the hydrocarbon feedstream to one or more hydrocracking reactors to produce a hydrocracked effluent. The hydrocracked effluent is fractioned to recover hydrocracked products and a hydrocracked bottoms fraction containing HPNA compounds and/or HPNA precursor compounds. The hydrocracked bottoms fraction is contacted with an effective quantity of a non-polar solvent to promote precipitation of HPNA compounds and/or HPNA precursor compounds. The soluble hydrocarbons in the hydrocracked bottoms fraction are separated into an HPNA-reduced hydrocracked bottoms portion. All or a portion of the HPNA-reduced hydrocracked bottoms portion is recycled.

In additional embodiments, the above methods for separation of HPNA compounds and/or HPNA precursor compounds by non-polar solvent extraction can be integrated in a two-stage hydrocracking configuration. Accordingly, in certain embodiments, a hydrocracking process for treating a heavy hydrocarbon feedstream which contains undesired nitrogen-containing compounds and poly-nuclear aromatic compounds is provided that comprises subjecting the hydrocarbon feedstream to a first hydrocracking stage to produce a first stage effluent. The first stage effluent is fractioned to recover hydrocracked products and a hydrocracked bottoms fraction containing HPNA compounds and/or HPNA precursor compounds. The hydrocracked bottoms fraction is contacted with an effective quantity of a non-polar solvent to promote precipitation of HPNA compounds and/or HPNA precursor compounds. The soluble hydrocarbons in the hydrocracked bottoms fraction are separated into an HPNA-reduced hydrocracked bottoms portion. All or a portion of the HPNA-reduced hydrocracked bottoms portion is passed to a second hydrocracking stage to produce a second hydrocracked effluent.

In certain embodiments, a process for separation of HPNA compounds and/or HPNA precursor compounds from a hydrocracked bottoms fraction prior to recycling within a hydrocracking operation comprises contacting the hydrocracked bottoms fraction with an effective quantity of a non-polar solvent to promote precipitation of HPNA compounds and/or HPNA precursor compounds, and separating into an HPNA-reduced hydrocracked bottoms portion and a precipitated HPNA portion; recycling all or a portion of the HPNA-reduced hydrocracked bottoms portion within the hydrocracking operation; and discharging the precipitated HPNA portion. In certain embodiments, two stage hydrocracking process comprises subjecting a hydrocarbon stream to a first hydrocracking stage to produce a first hydrocracked effluent; fractionating the first hydrocracked effluent to recover one or more hydrocracked product fractions and a bottoms fraction corresponding to the hydrocracked bottoms fraction of in the above process for separation of HPNA; wherein recycling all or a portion of the HPNA-reduced hydrocracked bottoms portion within the hydrocracking operation comprises passing all or a portion of the HPNA-reduced hydrocracked bottoms portion to a second hydrocracking stage to produce a second hydrocracked effluent; and optionally wherein the second hydrocracked effluent is fractionated with the first hydrocracked effluent. In certain embodiments, a hydrocracking process comprising subjecting a hydrocarbon stream to one or more hydrocracking stages to produce a hydrocracked effluent; fractionating the hydrocracked effluent to recover one or more hydrocracked product fractions and a hydrocracked bottoms fraction corresponding to the hydrocracked bottoms fraction of in the above process for separation of HPNA; and wherein recycling all or a portion of the HPNA-reduced hydrocracked bottoms portion within the hydrocracking operation comprises recycling all or a portion of the HPNA-reduced hydrocracked bottoms portion to at least one of the one or more hydrocracking stages. Contacting the hydrocracked bottoms fraction with an effective quantity of a non-polar solvent occurs under conditions effective to form a precipitated phase as the precipitated HPNA portion, and a soluble phase containing non-polar solvent and soluble compounds from the hydrocracked bottoms fraction, wherein the HPNA-reduced hydrocracked bottoms portion is obtained from the soluble phase. In certain embodiments the contacting occurs at temperature at or below the critical point of the non-polar solvent, a solvent-to-oil ratio (V/V) in the range of from about 2:1-50:1, and a pressure in a range that is effective to maintain the solvent/feed mixture in liquid phase. In certain embodiments, non-polar solvent is selected from the group consisting of saturated aliphatic hydrocarbons, C5-C11 paraffins and/or naphthenes, paraffinic C5-C11 naphthas, paraffinic C12-C15 kerosene, paraffinic C16-C20 diesel, normal and branched paraffins, and mixtures including at least one of the foregoing non-polar solvents. In certain embodiments, non-polar solvent is selected from the group consisting of C5-C7 paraffins, C5-C7 naphthenes, and C5-C11 paraffinic naphthas. In certain embodiments, at least a major portion of the non-polar solvent is derived from light naphtha obtained from the one or more hydrocracked product fractions. In certain embodiments the process further comprises separating non-polar solvent from the soluble phase and recovering the HPNA-reduced hydrocracked bottoms portion, and optionally recycling non-polar solvent to the step of contacting the hydrocracked bottoms fraction. In certain embodiments the contacting comprises admixing the hydrocracked bottoms fraction and the non-polar solvent; transferring the mixture of the hydrocracked bottoms fraction and the non-polar solvent to a settler to form the soluble phase and the precipitated phase; discharging the precipitated phase as the precipitated HPNA portion; separating non-polar solvent from the soluble phase and recovering the HPNA-reduced hydrocracked bottoms portion; and optionally recycling non-polar solvent to the step of contacting the hydrocracked bottoms fraction. In certain embodiments, the contacting comprises admixing the hydrocracked bottoms fraction and the non-polar solvent; transferring the mixture of the hydrocracked bottoms fraction and the non-polar solvent to a primary settler to form a primary soluble phase and a primary precipitated phase; passing the primary soluble phase to a secondary settler to form a secondary soluble phase and a secondary precipitated phase; separating non-polar solvent from the primary HPNA phase and discharging the secondary precipitated phase as the precipitated HPNA portion; separating non-polar solvent from the secondary soluble phase and discharging the HPNA-reduced hydrocracked bottoms portion; and optionally recycling non-polar solvent to the step of contacting the hydrocracked bottoms fraction. In certain embodiments the process further comprises contacting an additional feed with the non-polar solvent, wherein the additional feed is selected from the group consisting of one or more of straight run vacuum gas oil, treated vacuum gas oil, demetallized oil from solvent demetallizing operations, deasphalted oil from solvent deasphalting operations, coker gas oils from coker operations, cycle oils from fluid catalytic cracking operations including heavy cycle oil, and visbroken oils from visbreaking operations, and wherein the additional feed has a boiling point range within about 350-800° C.

In certain embodiments, a system for separation of HPNA compounds and/or HPNA precursor compounds from a hydrocracked bottoms fraction is provided comprising an HPNA separation zone having one or more inlets in fluid communication with a source of non-polar solvent, and one or more inlets in fluid communication with a hydrocracked bottoms outlet of a hydrocracking fractionating zone, the HPNA separation having one or more outlets for discharging an HPNA-reduced hydrocracked bottoms portion in fluid communication with a hydrocracking operation as a bottoms recycle stream, and one or more outlets for discharging a precipitated HPNA portion. In certain embodiments, a two stage hydrocracking system comprises a first hydrocracking reaction zone having one or more inlets in fluid communication with a source of an initial feedstock, and one or more outlets for discharging a first hydrocracked effluent stream; a fractionating zone having one or more inlets in fluid communication with the outlet(s) for discharging the first hydrocracked effluent stream, one or more outlets discharging a hydrocracked product fractions, and one or more outlets discharging a hydrocracked bottoms fraction in fluid communication with the HPNA separation zone as above; a second hydrocracking reaction zone having one or more inlets in fluid communication with the outlet(s) for discharging the HPNA-reduced hydrocracked bottoms portion of the HPNA separation zone as above, and one or more outlets discharging a second hydrocracked effluent stream; and optionally wherein the outlet(s) for discharging the second hydrocracked effluent is in fluid communication with the fractioning zone. In certain embodiments, a hydrocracking system comprises a hydrocracking reaction zone having one or more inlets in fluid communication with a source of an initial feedstock and is in fluid communication with the HPNA-reduced hydrocracked bottoms portion from the outlet(s) of the HPNA separation zone as above, and one or more outlets discharging an effluent stream; and a fractionating zone having one or more inlets in fluid communication with the outlet(s) for discharging the effluent stream, one or more outlets discharging a hydrocracked product fractions, and one or more outlets discharging a hydrocracked bottoms fraction in fluid communication with the inlet(s) of the HPNA separation zone as above. In certain embodiments, the HPNA separation zone includes a settler vessel and a flash vessel, the settler vessel including one or more inlets in fluid communication with the outlet(s) for discharging the hydrocracked bottoms fraction, one or more inlets in fluid communication with a source of non-polar solvent, one or more outlets for discharging a precipitated phase, and one or more outlets for discharging a soluble phase; the flash vessel including one or more inlets in fluid communication with the outlet(s) of the settler vessels, one or more outlets for discharging non-polar solvent, and one or more outlets for discharging the HPNA-reduced hydrocracked bottoms portion; and optionally wherein the outlet(s) for discharging the non-polar solvent is in fluid communication with the settler vessel inlet(s) for non-polar solvent. In certain embodiments, the HPNA separation zone includes a first settler vessel including one or more inlets in fluid communication with the outlet(s) for discharging the hydrocracked bottoms fraction, one or more inlets in fluid communication with a source of non-polar solvent, one or more outlets for discharging a primary precipitated phase, and one or more outlets for discharging a primary soluble phase; a second settler vessel including one or more inlets in fluid communication with the outlet(s) for discharging the primary soluble phase, one or more outlets for discharging a secondary precipitated phase as one part of the precipitated HPNA portion, and one or more outlets for discharging a secondary soluble phase; a first flash vessel including one or more inlets in fluid communication with the outlet(s) for discharging the primary precipitated phase, one or more outlets discharging non-polar solvent, and one or more outlets discharging another part of the precipitated HPNA portion; a second flash vessel including one or more inlets in fluid communication with the outlet(s) for discharging the secondary soluble phase, one or more outlets for discharging non-polar solvent, and one or more outlets for discharging the HPNA-reduced hydrocracked bottoms portion; and optionally wherein the outlet(s) for discharging the non-polar solvent is in fluid communication with the first settler vessel inlet(s) for non-polar solvent. In certain embodiments, the HPNA separation zone is also in fluid communication with a source of additional feed, wherein the source of additional feed is selected from the group consisting of one or more of straight run vacuum gas oil, treated vacuum gas oil, demetallized oil from solvent demetallizing operations, deasphalted oil from solvent deasphalting operations, coker gas oils from coker operations, cycle oils from fluid catalytic cracking operations including heavy cycle oil, and visbroken oils from visbreaking operations, and wherein the additional feed has a boiling point range within about 350-800° C. In certain embodiments, the source of non-polar solvent is selected from the group consisting of saturated aliphatic hydrocarbons, C5-C11 paraffins and/or naphthenes, paraffinic C5-C11 naphthas, paraffinic C12-C15 kerosene, paraffinic C16-C20 diesel, normal and branched paraffins, and mixtures including at least one of the foregoing non-polar solvents. In certain embodiments, the source of non-polar solvent is selected from the group consisting of C5-C7 paraffins, C5-C7 naphthenes, and C5-C11 paraffinic naphthas. In certain embodiments, the HPNA separation zone is in fluid communication with a light naphtha hydrocracked product fraction of the fractionating zone as a source of non-polar solvent.

Still other aspects, embodiments, and advantages of these exemplary aspects and embodiments, are discussed in detail below. Moreover, it is to be understood that both the foregoing information and the following detailed description are merely illustrative examples of various aspects and embodiments, and are intended to provide an overview or framework for understanding the nature and character of the claimed aspects and embodiments. The accompanying drawings are included to provide illustration and a further understanding of the various aspects and embodiments, and are incorporated in and constitute a part of this specification. The drawings, together with the remainder of the specification, serve to explain principles and operations of the described and claimed aspects and embodiments.

BRIEF DESCRIPTION OF THE DRAWINGS

The invention will be described in further detail below and with reference to the attached drawings in which the same or similar elements are referred to by the same number, and where.

DETAILED DESCRIPTION OF THE INVENTION

Figure 1:
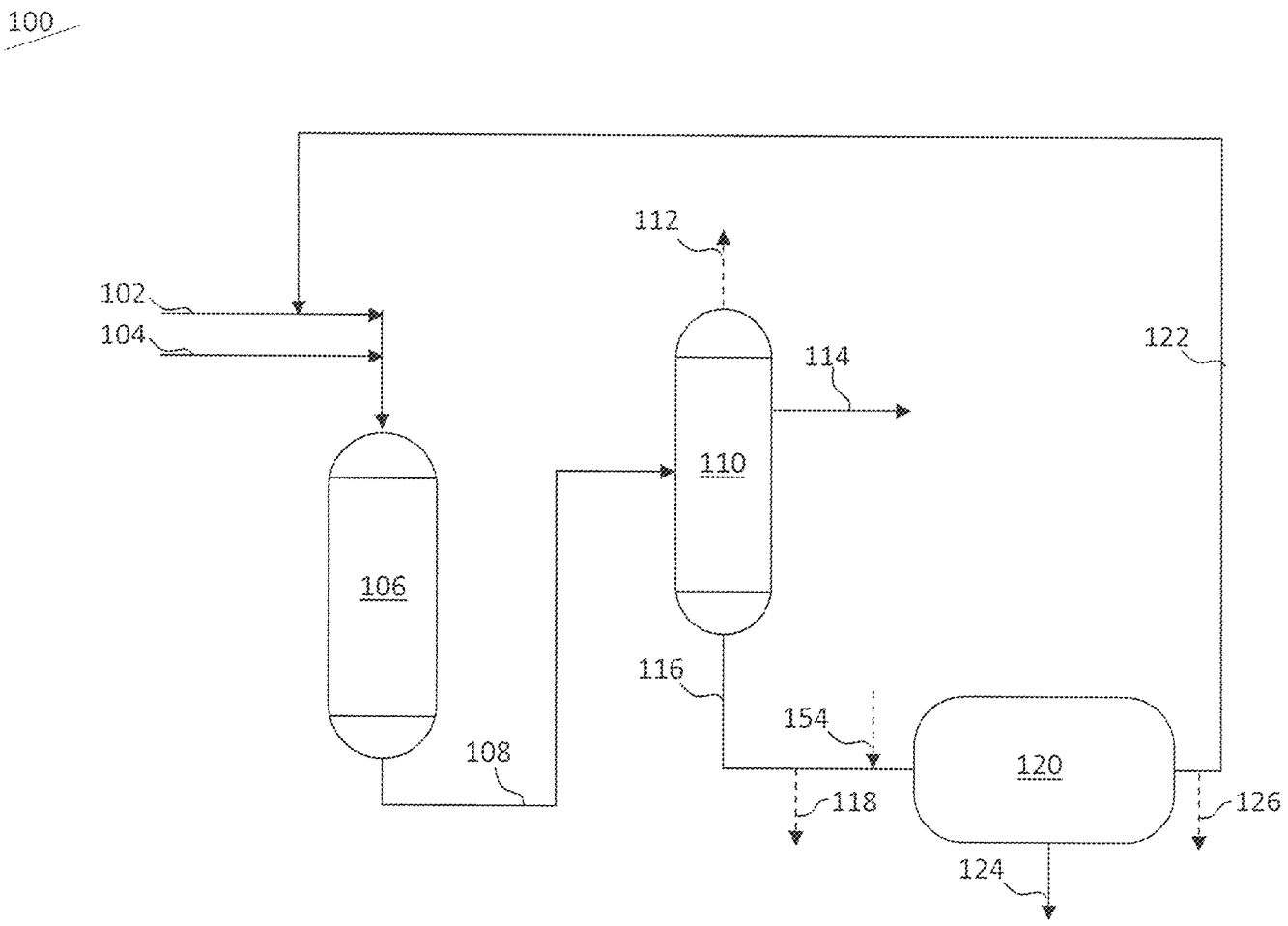
FIG. 1 is a process flow diagram of an embodiment of an integrated hydrocracking unit operation.

Integrated processes and systems are provided for to improve efficiency of hydrocracking operations, by removing HPNA and/or HPNA precursor compounds prior to recycling within a hydrocracking operation. The processes and systems herein are effective for different types of hydrocracking operations, and are also effective for a wide range of initial feedstocks obtained from various sources, such as one or more of straight run vacuum gas oil, treated vacuum gas oil, demetallized oil from solvent demetallizing operations, deasphalted oil from solvent deasphalting operations, coker gas oils from coker operations, cycle oils from fluid catalytic cracking operations including heavy cycle oil, and visbroken oils from visbreaking operations. The feedstream generally has a boiling point range within about 350-800, 350-700, 350-600 or 350-565° C.

As used herein, "HPNA compounds" and the shorthand expression "HPNA(s)" refers to fused polycyclic aromatic compounds having double bond equivalence (DBE) values of 19 and above, or having 7 or more rings, for example, including but not limited to coronene ($C_{24}H_{12}$), benzocoronene ($C_{28}H_{14}$), dibenzocorone ($C_{32}H_{16}$) and ovalene ($C_{32}H_{14}$). The aromatic structure may have alkyl groups or naphthenic rings attached to it. For instance, coronene has 24 carbon atoms and 12 hydrogen atoms. Its double bond equivalency (DBE) is 19. DBE is calculated based on the sum of the number double bonds and number of rings. For example, the DBE value for coronene is 19 (7 rings+12 double bonds). Alternatively, considering the DBE can be expressed based on the expression DBE=C−H/2+N/2+1; for coronene the DBE can be calculated as DBE=24−12/6−0/2+1=19. Examples of HPNA compounds are shown in Table 1.

As used herein, "HPNA precursors" are poly nuclear compounds having less than 7 aromatic rings.

As used herein, the term hydrocracking recycle stream is synonymous with the terms hydrocracker bottoms, hydrocracked bottoms, hydrocracker unconverted material and fractionator bottoms.

As used herein, the shorthand expressions "HPNAs/HPNA precursors," "HPNA compounds and HPNA precursor compounds," "HPNAs and HPNA precursors," and "HPNA compounds and/or HPNA precursor compounds" are used interchangeably and refer to a combination of HPNA compounds and HPNA precursor compounds unless more narrowly defined in context.

TABLE 1

| HPNAs | Ring # | Structure |
|---|---|---|
| benzoperylene | 6 | 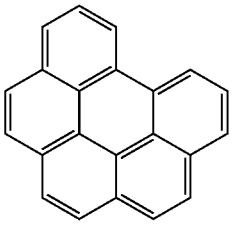 |

TABLE 1-continued

| HPNAs | Ring # | Structure |
|---|---|---|
| coronene | 7 | |
| methylcoronene | 7 | |
| naphthenocoronene | 9 | |
| dibenzocoronene | 9 | |
| ovalene | 10 | |

Volume percent or "V %" refers to a relative at conditions of 1 atmosphere pressure and 15° C.

The phrase "a major portion" with respect to a particular stream or plural streams, or content within a particular stream, means at least about 50 wt % and up to 100 wt %, or the same values of another specified unit.

The phrase "a significant portion" with respect to a particular stream or plural streams, or content within a particular stream, means at least about 75 wt % and up to 100 wt %, or the same values of another specified unit.

The phrase "a substantial portion" with respect to a particular stream or plural streams, or content within a particular stream, means at least about 90, 95, 98 or 99 wt % and up to 100 wt %, or the same values of another specified unit.

The phrase "a minor portion" with respect to a particular stream or plural streams, or content within a particular stream, means from about 1, 2, 4 or 10 wt %, up to about 20, 30, 40 or 50 wt %, or the same values of another specified unit.

The term "naphtha" as used herein refers to hydrocarbons boiling in the range of about 20-205, 20-193, 20-190, 20-180, 20-170, 32-205, 32-193, 32-190, 32-180, 32-170, 36-205, 36-193, 36-190, 36-180 or 36-170° C.

The term "light naphtha" as used herein refers to hydrocarbons boiling in the range of about 20-110, 20-100, 20-90, 20-88, 32-110, 32-100, 32-90, 32-88, 36-110, 36-100, 36-90 or 36-88° C.

The term "middle distillate" as used herein relative to effluents from the atmospheric distillation unit or flash zone refers to hydrocarbons boiling in the range between an initial boiling point from about 170° C. to 205° C. and final boiling point from about 320° C. to 370° C., for instance in the range of about 170-370, 170-360, 170-350, 170-340, 170-320, 180-370, 180-360, 180-350, 180-340, 180-320, 190-370, 190-360, 190-350, 190-340, 190-320, 193-370, 193-360, 193-350, 193-340, 193-320, 205-370, 205-360, 205-350, 205-340 or 205-320° C.

The term "unconverted oil" and its acronym "UCO," is used herein having its known meaning, and refers to a highly paraffinic fraction obtained from a separation zone associated with a hydroprocessing reactor, and contains reduced nitrogen, sulfur and nickel content relative to the reactor feed, and includes in certain embodiments hydrocarbons having an initial boiling point in the range of about 340-370° C., for instance about 340, 360 or 370° C., and an end point in the range of about 510-560° C., for instance about 540, 550, 560° C. or higher depending on the characteristics of the feed to the hydroprocessing reactor, and hydroprocessing reactor design and conditions. UCO is also known in the industry by other synonyms including "hydrowax."

The term "cracked diesel" refers to a hydrocarbon fraction obtained from a separation zone associated with a hydroprocessing reactor, and contains reduced nitrogen, sulfur and nickel content relative to the reactor feed, and includes in certain embodiments hydrocarbons having an initial boiling point corresponding to the end point of the cracked naphtha fraction(s) obtained from the separation zone associated with the hydroprocessing reactor, and having an end boiling point corresponding to the initial boiling point of the unconverted oil.

FIG. 1 is a process flow diagram of an embodiment of an integrated hydrocracking unit operation, system 100 including a hydrocracking reaction zone 106, a fractionating zone 110, and an HPNA separation zone 120. Reaction zone 106 generally includes one or more inlets in fluid communication with a source of initial feedstock 102, a source of hydrogen gas 104, and the HPNA separation zone 120 to receive a recycle stream comprising all or a portion of the HPNA-reduced bottoms fraction 122. Reaction zone 106 includes an effective reactor configuration with the requisite reaction vessel(s), feed heaters, heat exchangers, hot and/or cold separators, product fractionators, strippers, and/or other units to process, and operates with effective catalyst(s) and under effective operating conditions to carry out the desired degree of treatment and conversion of the feed. One or more outlets of reaction zone 106 that discharge effluent stream 108 are in fluid communication with one or more inlets of the fractionating zone 110. In certain embodiments (not shown), effluents from the hydrocracking reaction vessels are cooled in an exchanger and sent to a high pressure cold or hot separator. The fractionating zone 110 includes one or more outlets for discharging a distillate fraction 114 containing cracked naphtha and cracked middle distillate/diesel products and one or more outlets for discharging a bottoms fraction 116 containing unconverted oil. In certain embodiments, the fractionation zone 110 includes one or more outlets for discharging gases, stream 112, typically $H_2$, $H_2S$, $NH_3$, and light hydrocarbons ($C_1$-$C_4$).

The bottoms fraction 116 outlet is in fluid communication with one or more inlets of the HPNA separation zone 120. In certain embodiments one or more optional additional feeds, stream 154, are in fluid communication with one or more inlets of the HPNA separation zone 120. The HPNA separation zone 120 generally includes one or more outlets for discharging HPNA-reduced fractionator bottoms portion 122 and one or more outlets for discharging a precipitated HPNA portion 124 containing precipitated HPNA compounds and/or precipitated HPNA precursor compounds. The outlet discharging HPNA-reduced fractionator bottoms 122 is in fluid communication with one or more inlets of reaction zone 106 for recycle of all or a portion of the stream. In certain embodiments, a bleed stream 118 is drawn from bottoms 116 upstream of the HPNA separation zone 120. In additional embodiments, a bleed stream 126 is drawn from HPNA-reduced fractionator bottoms 122 downstream of the HPNA separation zone 120, in addition to or instead of bleed stream 118. Either or both of these bleed streams are hydrogen-rich and therefore can be effectively integrated with certain fuel oil pools, or serve as feed to fluidized catalytic cracking or steam cracking processes (not shown).

In operation of the system 100, a feedstock stream 102 and a hydrogen stream 104 are charged to the reaction zone 106. Hydrogen stream 104 contains an effective quantity of hydrogen to support the requisite degree of hydrocracking, feed type, and other factors, and can be any combination including make-up hydrogen, recycle hydrogen from optional gas separation subsystems (not shown) between reaction zone 106 and fractionating zone 110, and/or derived from fractionator gas stream 112. Reaction zone 106 operates under effective conditions for production of a reaction effluent stream 108 which contains converted, partially converted and unconverted hydrocarbons, including HPNA and/or HPNA precursor compounds formed in the reaction zone 106. One or more high pressure and low pressure separation stages can be integrated as is known to recover recycle hydrogen between the reaction zone 106 and fractionating zone 110. For example, effluents from the hydrocracking reaction vessel are cooled in an exchanger and sent to a high pressure cold or hot separator. Separator tops are cleaned in an amine unit and the resulting hydrogen rich gas stream is passed to a recycling compressor to be used as a recycle gas in the hydrocracking reaction vessel. Separator bottoms from the high pressure separator, which are in a substantially liquid phase, are cooled and then introduced to a low pressure cold separator. Remaining gases including hydrogen, $H_2S$, $NH_3$ and any light hydrocarbons, which can include $C_1$-$C_4$ hydrocarbons, can be conventionally purged from the low pressure cold separator and sent for further processing, such as flare processing or fuel gas processing. The liquid stream from the low pressure cold separator is passed to the fractionating zone 110.

The reaction effluent stream 108 is passed to fractionating zone 110, generally to recover gas stream 112 and liquid products 114 and to separate a bottoms fraction 116 containing HPNA compounds. Gas stream 112, typically containing $H_2$, $H_2S$, $NH_3$, and light hydrocarbons ($C_1$-$C_4$), is discharged and recovered and can be further processed as is known in the art, including for recovery of recycle hydrogen. In certain embodiments one or more gas streams are discharged from one or more separators between the reactor and the fractionator (not shown), and gas stream 112 can be optional from the fractionator. One or more cracked product streams 114 are discharged from appropriate outlets of the fractionator and can be further processed and/or blended in downstream refinery operations as gasoline, kerosene and/or diesel fuel products or intermediates, and/or other hydrocarbon mixtures that can be used to produce petrochemical products. In certain embodiments (not shown), fractionating zone 110 can operate as one or more flash vessels to separate heavy components at a suitable cut point, for example, a range corresponding to the upper temperature range of the desired product stream 114.

In certain embodiments, all, a major portion, a significant portion, or a substantial portion of the fractionator bottoms stream 116 derived from the reaction effluent, containing HPNA compounds and/or HPNA precursors formed in the reaction zone 106, is passed to the HPNA separation zone 120 for treatment. In certain embodiments a portion of the fractionator bottoms from the reaction effluent is removed from the recycle loop as bleed stream 118. Bleed stream 118 can contain a suitable portion (V %) of the fractionator bottoms 116, in certain embodiments about 0-10, 0-5, 0-3, 1-10, 1-5 or 1-3. The concentration of HPNA compounds and/or HPNA precursors in the hydrocracking effluent fractionator bottoms is reduced in the HPNA separation zone 120 to produce the HPNA-reduced fractionator bottoms stream 122 that is recycled to the reaction zone 106. In certain embodiments, instead of or in conjunction with bleed stream 118, a portion of the HPNA-reduced fractionator bottoms stream 122 is removed from the recycle loop as bleed stream 126. Bleed stream 126 can contain a suitable portion (V %) of the HPNA-reduced fractionator bottoms stream 122, in certain embodiments about 0-10, 0-5, 0-3, 1-10, 1-5 or 1-3. A discharge stream 124 containing precipitated HPNA compounds is removed from the HPNA separation zone 120. In certain embodiments, all, a major portion, a significant portion, or a substantial portion of the HPNA-reduced fractionator bottoms stream 122 is recycled to the reaction zone 106.

In additional embodiments, one or more optional additional feeds, stream 154 can be routed to the HPNA separation zone 120. Such additional feeds can be within a similar range as the hydrocracker bottoms stream fraction and/or the initial feedstock to the system 100, and selected from one or more of straight run vacuum gas oil, treated vacuum gas oil, demetallized oil from solvent demetallizing operations, deasphalted oil from solvent deasphalting operations, coker gas oils from coker operations, cycle oils from fluid catalytic cracking operations including heavy cycle oil, and visbroken oils from visbreaking operations, and generally has a boiling point range within about 350-800, 350-700, 350-600 or 350-565° C. For instance, the stream 154 can be in the range of about 0-100, 0-50, 10-100, 10-50, 20-100 or 20-50 V %, relative to the portion of the fractionator bottoms 116 fed to the HPNA separation zone 120. In certain embodiments the only feed to the HPNA separation zone 120 are derived from the fractionator bottoms 116.

Reaction zone 106 can contain one or more fixed-bed, ebullated-bed, slurry-bed, moving bed, continuous stirred tank (CSTR), or tubular reactors, in series and/or parallel arrangement. The reactor(s) are generally operated under conditions effective for the desired level of treatment, degree of conversion, type of reactor, the feed characteristics, and the desired product slate. In certain embodiments the reactors operate at conversion levels (V % of feed that is recovered above the unconverted oil range) in the range of 30-90, 50-90, 60-90 or 70-90. For instance, these conditions can include a reaction temperature (° C.) in the range of from about 300-500, 300-475, 300-450, 330-500, 330-475 or 330-450; a reaction pressure (bars) in the range of from about 60-300, 60-200, 60-180, 100-300, 100-200, 100-180, 130-300, 130-200 or 130-180; a hydrogen feed rate (standard liter per liter of hydrocarbon feed (SL/L)) of up to about 2500, 2000 or 1500, in certain embodiments from about 800-2500, 800-2000, 800-1500, 1000-2500, 1000-2000 or 1000-1500; and a feed rate liquid hourly space velocity ($h^{-1}$) in the range of from about 0.1-10, 0.1-5, 0.1-2, 0.25-10, 0.25-5, 0.25-2, 0.5-10, 0.5-5 or 0.5-2. Effective catalysts used in reaction zone 106 possess hydrotreating functionality (hydrodesulfurization, hydrodenitrification and/or hydrodemetallization) and hydrocracking functionality. Hydrodesulfurization, hydrodenitrification and/or hydrodemetallization is carried out to remove sulfur, nitrogen and other contaminants, and conversion of feedstocks occurs by cracking into lighter fractions, for instance, in certain embodiments at least about 30 V % conversion.

Figure 2:
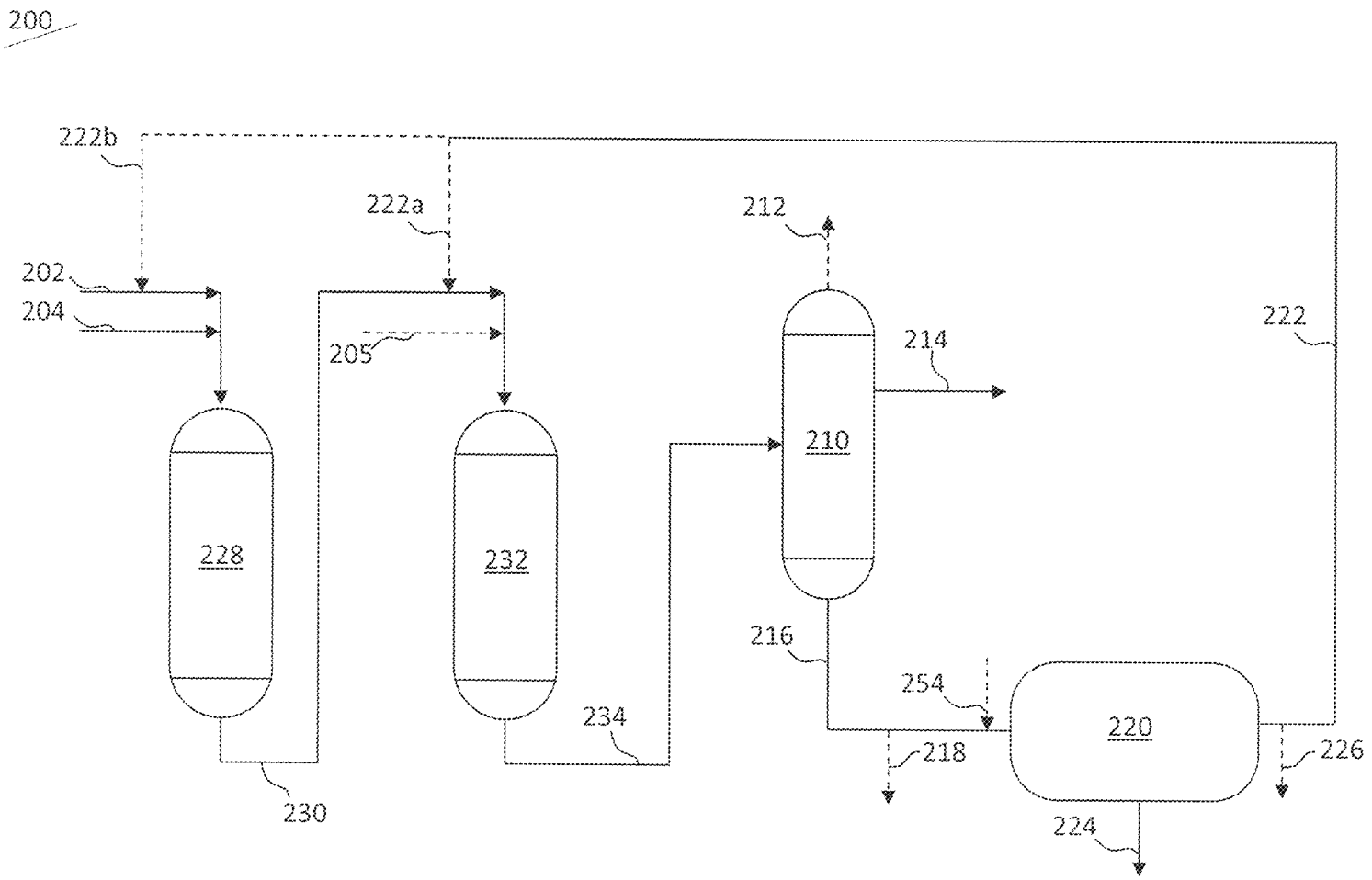
FIG. 2 is a process flow diagram of an integrated series-flow hydrocracking system.

FIG. 2 is a process flow diagram of another embodiment of an integrated hydrocracking unit operation, system 200, which operates as series-flow hydrocracking system with recycle to the first reactor zone, the second rector zone, or both the first and second reactor zones. In general, system 200 includes a first reaction zone 228, a second reaction zone 232, a fractionating zone 210, and an HPNA separation zone 220. The first reaction zone 228 generally includes one or more inlets in fluid communication with a source of initial feedstock 202, a source of hydrogen gas 204, and optionally the HPNA separation zone 220 to receive a recycle stream comprising all or a portion of the HPNA-reduced bottoms fraction 222, shown in dashed lines as stream 222*b*. The first reaction zone 228 includes an effective reactor configuration with the requisite reaction vessel(s), feed heaters, heat exchangers, hot and/or cold separators, product fractionators, strippers, and/or other units to process, and operates with effective catalyst(s) and under effective operating conditions to carry out the desired degree of treatment and conversion of the feed. One or more outlets of the first reaction zone 228 that discharge effluent stream 230 is in fluid communication with one or more inlets of the second reaction zone 232. In certain embodiments, the effluents 230 are passed to the second reaction zone 232 without separation of any excess hydrogen and light gases. In optional embodiments, one or more high pressure and low pressure separation stages are provided between the first and second reaction zones 228, 232 for recovery of recycle hydrogen (not shown). The second reaction zone 232 generally includes one or more inlets in fluid communication with one or more outlets of the first reaction zone 228, optionally a source of additional hydrogen gas 205 and optionally the HPNA separation zone 220 to receive a recycle stream comprising all or a portion of the HPNA-reduced reaction zone bottoms fraction 222, shown in dashed lines as stream 222*a*. The second reaction zone 232 includes an effective reactor configuration with the requisite reaction vessel(s), feed heaters, heat exchangers, hot and/or cold separators, product fractionators, strippers, and/or other units to process, and operates with effective catalyst(s) and under effective operating conditions to carry out the desired degree of additional conversion of the feed. One or more outlets of the second reaction zone 232 that discharge effluent stream 234 is in fluid communication with one or more inlets of the fractionating zone 210 (optionally having one or more high pressure and low pressure separation stages therebetween for recovery of recycle hydrogen, not shown). The fractionating zone 210 includes one or more outlets for discharging a distillate fraction 214 containing cracked naphtha and cracked middle distillate/diesel products and one or more outlets for discharging a bottoms fraction 216 containing unconverted oil. In certain embodiments, the fractionation zone 210 includes one or more outlets for discharging gases, stream 212, typically $H_2$, $H_2S$, $NH_3$, and light hydrocarbons ($C_1$-$C_4$).

The bottoms fraction 216 outlet is in fluid communication with one or more inlets of the HPNA separation zone 220. In certain embodiments one or more optional additional feeds, stream 254, are in fluid communication with one or more inlets of the HPNA separation zone 220. The HPNA separation zone 220 generally includes one or more outlets for discharging HPNA-reduced fractionator bottoms portion 222 and one or more outlets for discharging a precipitated HPNA portion 224 containing precipitated HPNA compounds and/or precipitated HPNA precursor compounds. The outlet discharging HPNA-reduced fractionator bottoms 222 is in fluid communication with one or more inlets of reaction zone 228 and/or 232 for recycle of all or a portion of the stream. In certain embodiments, a bleed stream 218 is drawn from bottoms 216 upstream of the HPNA separation zone 220. In additional embodiments, a bleed stream 226 is drawn from HPNA-reduced fractionator bottoms 222 downstream of the HPNA separation zone 220, in addition to or instead of bleed stream 218. Either or both of these bleed streams are hydrogen-rich and therefore can be effectively integrated with certain fuel oil pools, or serve as feed to fluidized catalytic cracking or steam cracking processes (not shown).

In operation of the system 200, a feedstock stream 202 and a hydrogen stream 204 are charged to the first reaction zone 228. Hydrogen stream 204 includes an effective quantity of hydrogen to support the requisite degree of hydrocracking, feed type, and other factors, and can be any combination including make-up hydrogen, recycle hydrogen from optional gas separation subsystems (not shown) between reaction zones 228 and 232, recycle hydrogen from optional gas separation subsystems (not shown) between reaction zone 232 and fractionator 210, and/or derived from fractionator gas stream 212. The first reaction zone 228 operates under effective conditions for production of a reaction effluent stream 230 (optionally after one or more high pressure and low pressure separation stages to recover recycle hydrogen) which is passed to the second reaction zone 232, optionally along with an additional hydrogen stream 205. The second reaction zone 232 operates under conditions effective for production of the reaction effluent stream 234, which contains converted, partially converted and unconverted hydrocarbons. The reaction effluent stream further includes HPNA compounds that were formed in the reaction zones 228 and/or 232. One or more high pressure and low pressure separation stages can be integrated as is known to recover recycle hydrogen between the reaction zone 228 and the reaction zone 232, and/or between the reaction zone 232 and fractionating zone 210. For example, effluents from the hydrocracking reaction zones 228 and/or 232 are cooled in an exchanger and sent to a high pressure cold or hot separator. Separator tops are cleaned in an amine unit and the resulting hydrogen rich gas stream is passed to a recycling compressor to be used as a recycle gas in the hydrocracking reaction vessel. Separator bottoms from the high pressure separator, which are in a substantially liquid phase, are cooled and then introduced to a low pressure cold separator. Remaining gases including hydrogen, $H_2S$, $NH_3$ and any light hydrocarbons, which can include $C_1$-$C_4$ hydrocarbons, can be conventionally purged from the low pressure cold separator and sent for further processing, such as flare processing or fuel gas processing. The liquid stream from the low pressure cold separator is passed to the next stage, that is, the second reactor 232 or the fractionating zone 210.

The reaction effluent stream 234 is passed to the fractionation zone 210, generally to recover gas stream 212 and liquid products 214 and to separate a bottoms fraction 216 containing HPNA compounds. Gas stream 212, typically containing $H_2$, $H_2S$, $NH_3$, and light hydrocarbons ($C_1$-$C_4$), is discharged and recovered and can be further processed as is known in the art, including for recovery of recycle hydrogen. In certain embodiments one or more gas streams are discharged from one or more separators between the reactors, or between the reactor and the fractionator (not shown), and gas stream 212 can be optional from the fractionator. One or more cracked product streams 214 are discharged from appropriate outlets of the fractionator and can be further processed and/or blended in downstream refinery operations as gasoline, kerosene and/or diesel fuel products or intermediates, and/or other hydrocarbon mixtures that can be used to produce petrochemical products. In certain embodiments (not shown), fractionating zone 210 can operate as one or more flash vessels to separate heavy components at a suitable cut point, for example, a range corresponding to the upper temperature range of the desired product stream 214.

In certain embodiments, all, a major portion, a significant portion, or a substantial portion of the fractionator bottoms stream 216, containing HPNA compounds and/or HPNA precursors formed in the reaction zones, is passed to the HPNA separation zone 220 for treatment. In certain embodiments a portion of the fractionator bottoms from the reaction effluent is removed from the recycle loop as bleed stream 218. Bleed stream 218 can contain a suitable portion (V %) of the fractionator bottoms 216, in certain embodiments about 0-10, 0-5, 0-3, 1-10, 1-5 or 1-3. The concentration of HPNA compounds and/or HPNA precursors in the fractionator bottoms is reduced in the HPNA separation zone 220 to produce the HPNA-reduced fractionator bottoms stream 222. A discharge stream 224 containing precipitated HPNA compounds is removed from the HPNA separation zone 220. In certain embodiments, instead of or in conjunction with bleed stream 218, a portion of the HPNA-reduced fractionator bottoms stream 222 is removed from the recycle loop as bleed stream 226. Bleed stream 226 can contain a suitable portion (V %) of the HPNA-reduced fractionator bottoms stream 222, in certain embodiments about 0-10, 0-5, 0-3, 1-10, 1-5 or 1-3. In certain embodiments, all or a portion of the HPNA-reduced fractionator bottoms stream 222 is recycled to the second reaction zone 232 as stream 222*a*, the first reaction zone 228 as stream 222*b*, or both the first and second reaction zones 228 and 232. For instance, stream 222*b* comprises (V %) 0-100, 0-80 or 0-50 relative to stream 222 that is recycled to zone 228, and stream 222*a* comprises 0-100, 0-80 or 0-50 relative to stream 222 that is recycled to zone 232. In certain embodiments, all, a major portion, a significant portion, or a substantial portion of the HPNA-reduced fractionator bottoms 222 is recycled to the first reaction zone 228 as stream 222*b*.

In additional embodiments, one or more optional additional feeds, stream 254 can be routed to the HPNA separation zone 220. Such additional feeds can be within a similar range as the hydrocracked bottoms fraction and/or the initial feedstock to the system 200, and selected from one or more of straight run vacuum gas oil, treated vacuum gas oil, demetallized oil from solvent demetallizing operations, deasphalted oil from solvent deasphalting operations, coker gas oils from coker operations, cycle oils from fluid catalytic cracking operations including heavy cycle oil, and visbroken oils from visbreaking operations, and generally has a boiling point in the range within about 350-800, 350-700, 350-600 or 350-565° C. For instance, the stream 254 can be in the range of about 0-100, 0-50, 10-100, 10-50, 20-100 or 20-50 V %, relative to the portion of the fractionator bottoms 216 fed to the HPNA separation zone 220. In certain embodiments the only feed to the HPNA separation zone 220 are derived from the fractionator bottoms 216.

The first reaction zone 228 can contain one or more fixed-bed, ebullated-bed, slurry-bed, moving bed, CSTR, or tubular reactors, in series and/or parallel arrangement. The reactor(s) are generally operated under conditions effective for the desired level of treatment and degree of conversion in the first reaction zone 228, the particular type of reactor, the feed characteristics, and the desired product slate. For instance, these conditions can include a reaction temperature (° C.) in the range of from about 300-500, 300-475, 300-450, 330-500, 330-475 or 330-450; a reaction pressure (bars) in the range of from about 60-300, 60-200, 60-180, 100-300, 100-200, 100-180, 130-300, 130-200 or 130-180; a hydrogen feed rate (SL/L) of up to about 2500, 2000 or 1500, in certain embodiments from about 800-2500, 800-2000, 800-1500, 1000-2500, 1000-2000 or 1000-1500; and a feed rate liquid hourly space velocity (h) in the range of from about 0.1-10, 0.1-5, 0.1-2, 0.25-10, 0.25-5, 0.25-2, 0.5-10, 0.5-5 or 0.5-2. The catalyst used in the first reaction zone 228 can comprise those having hydrotreating functionality, and in certain embodiments those having hydrotreating and hydrocracking functionality. In embodiments in which catalysts used in first reaction zone 228 possess hydrotreating functionality, including hydrodesulfurization, hydrodenitrification and/or hydrodemetallization, the focus is removal of sulfur, nitrogen and other contaminants, with a limited degree of conversion (for instance in the range of 10-30V %). In embodiments in which catalysts used in first reaction zone 228 possess hydrotreating and hydrocracking functionality, a higher degree of conversion, generally above about 30 V %, occurs.

The second reaction zone 232 can contain one or more fixed-bed, ebullated-bed, slurry-bed, moving bed, CSTR, or tubular reactors, in series and/or parallel arrangement. The reactor(s) are generally operated under conditions effective for the desired degree of conversion, particular type of reactor, the feed characteristics, and the desired product slate. For instance, these conditions can include a reaction temperature (° C.) in the range of from about 300-500, 300-475, 300-450, 330-500, 330-475 or 330-450; a reaction pressure (bars) in the range of from about 60-300, 60-200, 60-180, 100-300, 100-200, 100-180, 130-300, 130-200 or 130-180; a hydrogen feed rate (SL/L) of up to about 2500, 2000 or 1500, in certain embodiments from about 800-2500, 800-2000, 800-1500, 1000-2500, 1000-2000 or 1000-1500; and a feed rate liquid hourly space velocity (h) in the range of from about 0.1-10, 0.1-5, 0.1-2, 0.25-10, 0.25-5, 0.25-2, 0.5-10, 0.5-5 or 0.5-2. The catalyst used in the second reaction zone 232 can comprise those having hydrocracking functionality, and in certain embodiments those having hydrocracking and hydrogenation functionality.

Figure 3:
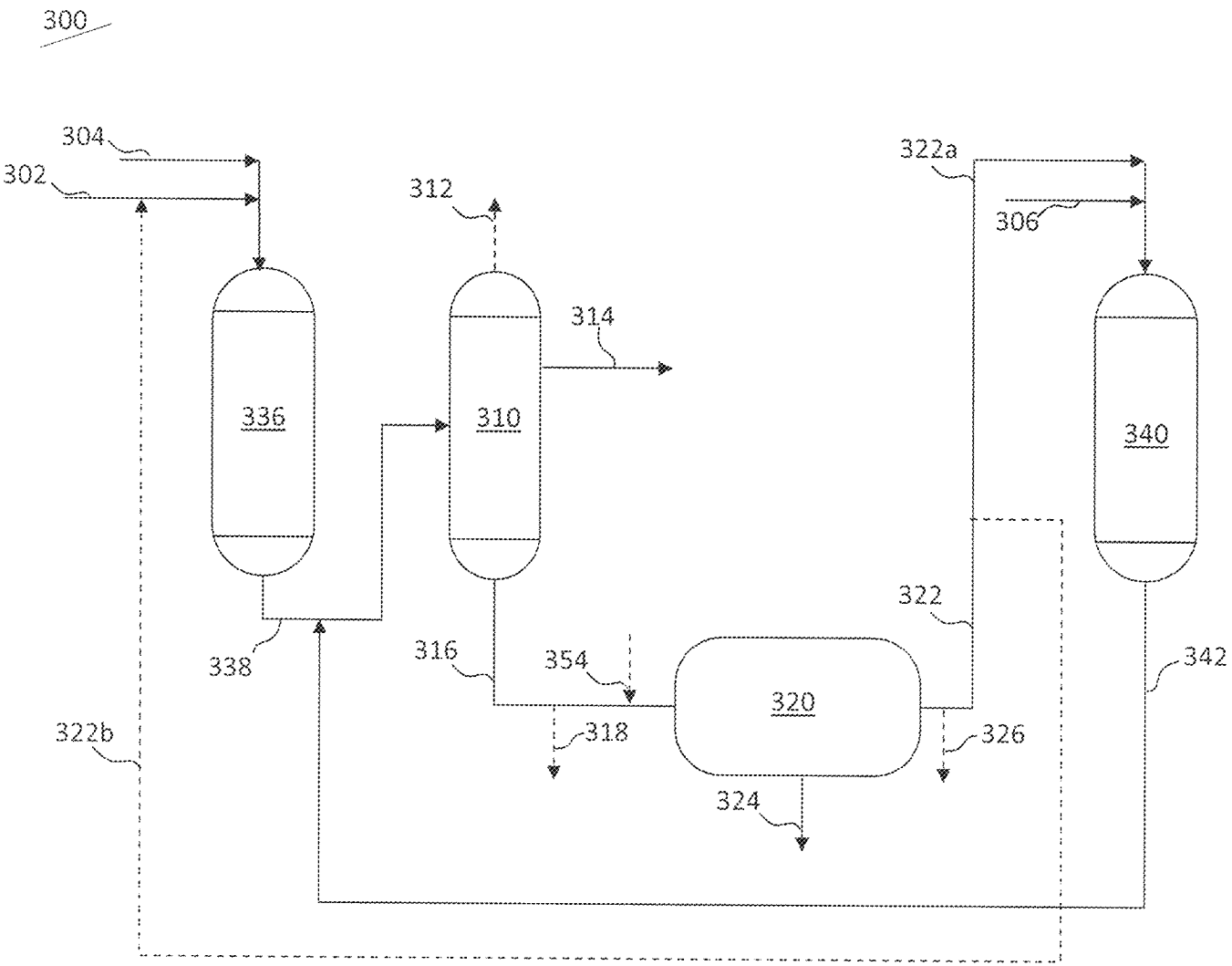
FIG. 3 is a process flow diagram of an integrated two-stage hydrocracking system with recycle.

FIG. 3 is a process flow diagram of another embodiment of an integrated hydrocracking unit operation, system 300, which operates as two-stage hydrocracking system with recycle. In general, system 300 includes a first reaction zone 336, a second reaction zone 340, a fractionating zone 310, and an HPNA separation zone 320. The first reaction zone 336 generally includes one or more inlets in fluid communication with a source of initial feedstock 302 and a source of hydrogen gas 304. The first reaction zone 336 includes an effective reactor configuration with the requisite reaction vessel(s), feed heaters, heat exchangers, hot and/or cold separators, product fractionators, strippers, and/or other units to process, and operates with effective catalyst(s) and under effective operating conditions to carry out the desired degree of treatment and conversion of the feed. One or more outlets of the first reaction zone 336 that discharge effluent stream 338 is in fluid communication with one or more inlets of the fractionating zone 310 (optionally having one or more high pressure and low pressure separation stages therebetween for recovery of recycle hydrogen, not shown). The fractionating zone 310 includes one or more outlets for discharging a distillate fraction 314 containing cracked naphtha and cracked middle distillate/diesel products; and one or more outlets for discharging a bottoms fraction 316 containing unconverted oil. In certain embodiments, the fractionation zone 310 includes one or more outlets for discharging gases, stream 312, typically $H_2$, $H_2S$, $NH_3$, and light hydrocarbons ($C_1$-$C_4$). The second reaction zone 340 generally includes one or more inlets in fluid communication with one or more outlets of the HPNA separation zone 320 for receiving an HPNA-reduced fractionator bottoms stream 322*a* and a source of hydrogen gas 306. The second reaction zone 340 includes an effective reactor configuration with the requisite reaction vessel(s), feed heaters, heat exchangers, hot and/or cold separators, product fractionators, strippers, and/or other units to process, and operates with effective catalyst(s) and under effective operating conditions to carry out the desired degree of additional conversion of the feed. One or more outlets of the second reaction zone 340 that discharge effluent stream 342 are in fluid communication with one or more inlets of the fractionating zone 310 (optionally having one or more high pressure and low pressure separation stages for recovery of recycle hydrogen, not shown).

The bottoms fraction 316 outlet is in fluid communication with one or more inlets of the HPNA separation zone 320. In certain embodiments one or more optional additional feeds, stream 354, are in fluid communication with one or more inlets of the HPNA separation zone 320. The HPNA separation zone 320 generally includes one or more outlets for discharging a precipitated HPNA-reduced fractionator bottoms 322 and one or more outlets for discharging a precipitated HPNA portion 324 containing precipitated HPNA compounds and/or precipitated HPNA precursor compounds. The outlet discharging HPNA-reduced fractionator bottoms 322 is in fluid communication with one or more inlets of the second reaction zone 340 for recycle of all or a portion 322*a* of the recycle stream 322. In certain optional embodiments, a portion 322*b*, shown in dashed lines, is in fluid communication with one or more inlets of the first reaction zone 336. In certain embodiments, a bleed stream 318 is drawn from bottoms 316 upstream of the HPNA separation zone 320. In additional embodiments, a bleed stream 326 is drawn from HPNA-reduced fractionator bottoms 322 downstream of the HPNA separation zone 320, in addition to or instead of bleed stream 318. Either or both of these bleed streams are hydrogen-rich and therefore can be effectively integrated with certain fuel oil pools, or serve as feed to fluidized catalytic cracking or steam cracking processes (not shown).

In operation of the system 300, a feedstock stream 302 and a hydrogen stream 304 are charged to the first reaction zone 336. Hydrogen stream 304 includes an effective quantity of hydrogen to support the requisite degree of hydrocracking, feed type, and other factors, and can be any combination including make-up hydrogen, recycle hydrogen from optional gas separation subsystems (not shown) between first reaction zone 336 and fractionating zone 310, recycle hydrogen from optional gas separation subsystems (not shown) between second reaction zone 340 and fractionating zone 310, and/or derived from fractionator gas stream 312. The first reaction zone 336 operates under effective conditions for production of reaction effluent stream 338. The reaction effluent stream further includes HPNA compounds that were formed in the reaction zone 336. One or more high pressure and low pressure separation stages can be integrated as is known to recover recycle hydrogen between the reaction zone 336 and the fractionating zone 310. For example, effluents from the hydrocracking reaction vessel are cooled in an exchanger and sent to a high pressure cold or hot separator. Separator tops are cleaned in an amine unit and the resulting hydrogen rich gas stream is passed to a recycling compressor to be used as a recycle gas in the hydrocracking reaction vessel. Separator bottoms from the high pressure separator, which are in a substantially liquid phase, are cooled and then introduced to a low pressure cold separator. Remaining gases including hydrogen, $H_2S$, $NH_3$ and any light hydrocarbons, which can include $C_1$-$C_4$ hydrocarbons, can be conventionally purged from the low pressure cold separator and sent for further processing, such as flare processing or fuel gas processing. The liquid stream from the low pressure cold separator is passed to the fractionating zone 310.

The reaction effluent stream 338 is passed to the fractionation zone 310, generally to recover gas stream 312 and liquid products 314 and to separate a bottoms fraction 316 containing HPNA compounds. Gas stream 312, typically containing $H_2$, $H_2S$, $NH_3$, and light hydrocarbons ($C_1$-$C_4$), is discharged and recovered and can be further processed as is known in the art, including for recovery of recycle hydrogen. In certain embodiments one or more gas streams are discharged from one or more separators between the reactors (not shown), or between the reactor and the fractionator, and gas stream 312 can be optional from the fractionator. One or more cracked product streams 314 are discharged from appropriate outlets of the fractionator and can be further processed and/or blended in downstream refinery operations as gasoline, kerosene and/or diesel fuel products or intermediates, and/or other hydrocarbon mixtures that can be used to produce petrochemical products. In certain embodiments (not shown), fractionating zone 310 can operate as one or more flash vessels to separate heavy components at a suitable cut point, for example, a range corresponding to the upper temperature range of the desired product stream 314.

In certain embodiments, all, a major portion, a significant portion, or a substantial portion of the fractionator bottoms stream 316 containing HPNA compounds and/or HPNA precursors formed in the reaction zones is passed to the HPNA separation zone 320 for treatment. In certain embodiments a portion of the fractionator bottoms from the reaction effluent is removed as bleed stream 318. Bleed stream 318 can contain a suitable portion (V %) of the fractionator bottoms 316, in certain embodiments about 0-10, 0-5, 0-3, 1-10, 1-5 or 1-3. The concentration of HPNA compounds and/or HPNA precursors in the fractionator bottoms is reduced in the HPNA separation zone 320 to produce the HPNA-reduced fractionator bottoms stream 322. A discharge stream 324 containing precipitated HPNA compounds is removed from the HPNA separation zone 320. In certain embodiments, instead of or in conjunction with bleed stream 318, a portion of the HPNA-reduced fractionator bottoms stream 322 is removed from the recycle loop as bleed stream 326. Bleed stream 326 can contain a suitable portion (V %) of the HPNA-reduced fractionator bottoms stream 322, in certain embodiments about 0-10, 0-5, 0-3, 1-10, 1-5 or 1-3. In certain embodiments, or a portion of the HPNA-reduced fractionator bottoms stream 322 is passed to the second reaction zone 340 as stream 322*a*. In certain embodiments, all or a portion of the HPNA-reduced fractionator bottoms stream 322 is recycled to the second reaction zone 340 as stream 322*a*, the first reaction zone 336 as stream 322*b*, or both the first and second reaction zones 336 and 340. For instance, stream 322*a* comprises (V %) 0-100, 0-80 or 0-50 relative to stream 322 that is recycled to zone 340, and stream 322*b* comprises 0-100, 0-80 or 0-50 relative to stream 322 that is recycled to zone 336. In certain embodiments, all, a major portion, a significant portion, or a substantial portion of the HPNA-reduced fractionator bottoms 322 is passed to the second reaction zone 340 as stream 322*a*. The second reaction zone 340 operates under conditions effective for production of the reaction effluent stream 342, which contains converted, partially converted and unconverted hydrocarbons. The second stage the reaction effluent stream 342 is passed to the fractionating zone 310, optionally through one or more gas separators to recovery recycle hydrogen and remove certain light gases.

In additional embodiments, one or more optional additional feeds, stream 354 can be routed to the HPNA separation zone 320. Such additional feeds can be within a similar range as the hydrocracked bottoms fraction and/or the initial feedstock to the system 300, and selected from one or more of straight run vacuum gas oil, treated vacuum gas oil, demetallized oil from solvent demetallizing operations, deasphalted oil from solvent deasphalting operations, coker gas oils from coker operations, cycle oils from fluid catalytic cracking operations including heavy cycle oil, and visbroken oils from visbreaking operations, and generally has a boiling point in the range within about 350-800, 350-700, 350-600 or 350-565° C. For instance, the stream 354 can be in the range of about 0-100, 0-50, 10-100, 10-50, 20-100 or 20-50 V %, relative to the portion of the fractionator bottoms 316 fed to the HPNA separation zone 320. In certain embodiments the only feed to the HPNA separation zone 320 are derived from the fractionator bottoms 316.

The first reaction zone 336 can contain one or more fixed-bed, ebullated-bed, slurry-bed, moving bed, CSTR, or tubular reactors, in series and/or parallel arrangement. The reactor(s) are generally operated under conditions effective for the desired level of treatment and degree of conversion in the first reaction zone 336, the particular type of reactor, the feed characteristics, and the desired product slate. For instance, these conditions can include a reaction temperature (° C.) in the range of from about 300-500, 300-475, 300-450, 330-500, 330-475 or 330-450; a reaction pressure (bars) in the range of from about 60-300, 60-200, 60-180, 100-300, 100-200, 100-180, 130-300, 130-200 or 130-180; a hydrogen feed rate (SL/L) of up to about 2500, 2000 or 1500, in certain embodiments from about 800-2500, 800-2000, 800-1500, 1000-2500, 1000-2000 or 1000-1500; and a feed rate liquid hourly space velocity ($h^{-1}$) in the range of from about 0.1-10, 0.1-5, 0.1-2, 0.25-10, 0.25-5, 0.25-2, 0.5-10, 0.5-5 or 0.5-2. The catalyst used in the first reaction zone 336 can comprise those having hydrotreating functionality, and in certain embodiments those having hydrotreating and hydrocracking functionality. In embodiments in which catalysts used in first reaction zone 336 possess hydrotreating functionality, including hydrodesulfurization, hydrodenitrification and/or hydrodemetallization, the focus is removal of sulfur, nitrogen and other contaminants, with a limited degree of conversion (for instance in the range of 10-30 V %). In embodiments in which catalysts used in first reaction zone 336 possess hydrotreating and hydrocracking functionality, a higher degree of conversion occurs, generally above about 30 V %, for instance in the range of about 30-60 V %.

The second reaction zone 340 can contain one or more fixed-bed, ebullated-bed, slurry-bed, moving bed, CSTR, or tubular reactors, in series and/or parallel arrangement. The reactor(s) are generally operated under conditions effective for the desired degree of conversion, particular type of reactor, the feed characteristics, and the desired product slate. For instance, these conditions can include a reaction temperature (° C.) in the range of from about 300-500, 300-475, 300-450, 330-500, 330-475 or 330-450; a reaction pressure (bars) in the range of from about 60-300, 60-200, 60-180, 100-300, 100-200, 100-180, 130-300, 130-200 or 130-180; a hydrogen feed rate (SL/L) of up to about 2500, 2000 or 1500, in certain embodiments from about 800-2500, 800-2000, 800-1500, 1000-2500, 1000-2000 or 1000-1500; and a feed rate liquid hourly space velocity ($h^{-1}$) in the range of from about 0.1-10, 0.1-5, 0.1-2, 0.25-10, 0.25-5, 0.25-2, 0.5-10, 0.5-5 or 0.5-2. The catalyst used in the second reaction zone 340 can comprise those having hydrocracking functionality for further conversion of refined and partially cracked components from the feedstock, and in certain embodiments those having hydrocracking and hydrogenation functionality.

Effective catalysts used in embodiments in which those possessing hydrotreating functionality required, for instance, in first reaction zone 228 or first reaction zone 336, are known. Such hydrotreating catalysts, sometimes referred to in the industry as "pretreat catalyst," are effective for hydrotreating, and inherently a limited degree of conversion occurs (generally below about 30 V %). The catalysts generally contain one or more active metal components of metals or metal compounds (oxides or sulfides) selected from the Periodic Table of the Elements IUPAC Groups 6, 7, 8, 9 and 10. One or more active metal component(s) are typically deposited or otherwise incorporated on a support, which can be amorphous and/or structured, such as alumina, silica-alumina, silica, titania, titania-silica or titania-silicates. Combinations of active metal components can be composed of different particles/granules containing a single active metal species, or particles containing multiple active species. For example, effective hydrotreating catalysts include one or more of an active metal component selected from the group consisting of cobalt, nickel, tungsten, molybdenum (oxides or sulfides), incorporated on an alumina support, typically with other additives. In certain embodiments in which an objective is hydrodenitrification and treatment of difficult feedstocks such as demetallized oil, the supports are acidic alumina, silica alumina or a combination thereof. In embodiments in which the objective is hydrodenitrification increases hydrocarbon conversion, the supports are silica alumina, or a combination thereof. Silica alumina is useful for difficult feedstocks for stability and enhanced cracking. In certain embodiments, the catalyst particles have a pore volume in the range of about (cc/gm) 0.15-1.70, 0.15-1.50, 0.30-1.50 or 0.30-1.70; a specific surface area in the range of about ($m^2/g$) 100-400, 100-350, 100-300, 150-400, 150-350, 150-300, 200-400, 200-350 or 200-300; and an average pore diameter of at least about 10, 50, 100, 200, 500 or 1000 angstrom units. The active metal component(s) are incorporated in an effective concentration, for instance, in the range of (wt % based on the mass of the oxides, sulfides or metals relative to the total mass of the catalysts) 1-40, 1-30, 1-10, 1-5, 2-40, 2-30, 2-10, 3-40, 3-30 or 3-10. In certain embodiments, the active metal component(s) include one or more of cobalt, nickel, tungsten and molybdenum, and effective concentrations are based on all the mass of active metal components on an oxide basis. In certain embodiments, hydrotreating catalysts are configured in one or more beds selected from nickel/tungsten/molybdenum, cobalt/molybdenum, nickel/molybdenum, nickel/tungsten, and cobalt/nickel/molybdenum. Combinations of one or more beds of nickel/tungsten/molybdenum, cobalt/molybdenum, nickel/molybdenum, nickel/tungsten and cobalt/nickel/molybdenum, are useful for difficult feedstocks such as demetallized oil, and to increase hydrocracking functionality. In additional embodiments, the catalyst includes a bed of cobalt/molybdenum catalysts and a bed of nickel/molybdenum catalysts.

Effective catalysts used in embodiments where those possessing hydrotreating and hydrocracking functionality are required, for instance, reaction zone 106, first reaction zone 228 or first reaction zone 336, are known. These catalysts, effective for hydrotreating and a degree of conversion generally in the range of about 30-60 V %, contain one or more active metal components of metals or metal compounds (oxides or sulfides) selected from the Periodic Table of the Elements IUPAC Groups 6, 7, 8, 9 and 10. One or more active metal component(s) are typically deposited or otherwise incorporated on a support, which can be amorphous and/or structured, such as alumina, silica-alumina, silica, titania, titania-silica, titania-silicates, or zeolites. Combinations of active metal components can be composed of different particles/granules containing a single active metal species, or particles containing multiple active species. For example, effective hydrotreating/hydrocracking catalysts include one or more of an active metal component selected from the group consisting of cobalt, nickel, tungsten, molybdenum (oxides or sulfides), incorporated on acidic alumina, silica alumina, zeolite or a combination thereof. In embodiments in which zeolites are used, they are conventionally formed with one or more binder components such as alumina, silica, silica-alumina and mixtures thereof. In certain embodiments in which an objective is hydrodenitrification and treatment of difficult feedstocks such as demetallized oil, the supports are acidic alumina, silica alumina or a combination thereof. In embodiments in which the objective is hydrodenitrification increases hydrocarbon conversion, the supports are silica alumina, or a combination thereof. Silica alumina is useful for difficult feedstocks for stability and enhanced cracking. In certain embodiments, the catalyst particles have a pore volume in the range of about (cc/gm) 0.15-1.70, 0.15-1.50, 0.30-1.50 or 0.30-1.70; a specific surface area in the range of about ($m^2/g$) 100-900, 100-500, 100-450, 180-900, 180-500, 180-450, 200-900, 200-500 or 200-450; and an average pore diameter of at least about 45, 50, 100, 200, 500 or 1000 angstrom units. The active metal component(s) are incorporated in an effective concentration, for instance, in the range of (wt % based on the mass of the oxides, sulfides or metals relative to the total mass of the catalysts) 1-40, 1-30, 1-10, 1-5, 2-40, 2-30, 2-10, 3-40, 3-30 or 3-10. In certain embodiments, the active metal component(s) include one or more of cobalt, nickel, tungsten and molybdenum, and effective concentrations are based on all the mass of active metal components on an oxide basis. In certain embodiments, one or more beds are provided in series in a single reactor or in a series of reactors. For instance, a first catalyst bed containing active metals on silica alumina support is provided for hydrodenitrogenation, hydrodesulfurization and hydrocracking functionalities, followed by a catalyst bed containing active metals on zeolite support for hydrocracking functionality.

Effective catalysts used in embodiments where those possessing hydrocracking functionality, for instance, second reaction zone 232 or second reaction zone 340, are known. These catalysts, effective for further conversion of refined and partially cracked components from the feedstock, contain one or more active metal components of metals or metal compounds (oxides or sulfides) selected from the Periodic Table of the Elements IUPAC Groups 6, 7, 8, 9 and 10. One or more active metal component(s) are typically deposited or otherwise incorporated on a support, which can be amorphous and/or structured, such as silica-alumina, silica, titania, titania-silica, titania-silicates, or zeolites. Combinations of active metal components can be composed of different particles/granules containing a single active metal species, or particles containing multiple active species. In embodiments in which zeolites are used, they are conventionally formed with one or more binder components such as alumina, silica, silica-alumina and mixtures thereof. For example, effective hydrocracking catalysts include one or more of an active metal component selected from the group consisting of nickel, tungsten, molybdenum (oxides or sulfides), incorporated on acidic alumina, silica alumina, zeolite or a combination thereof. In certain embodiments, the catalyst particles have a pore volume in the range of about (cc/gm) 0.15-1.70, 0.15-1.50, 0.30-1.50 or 0.30-1.70; a specific surface area in the range of about ($m^2/g$) 100-900, 100-500, 100-450, 180-900, 180-500, 180-450, 200-900, 200-500 or 200-450; and an average pore diameter of at least about 45, 50, 100, 200, 500 or 1000 angstrom units. The active metal component(s) are incorporated in an effective concentration, for instance, in the range of (wt % based on the mass of the oxides, sulfides or metals relative to the total mass of the catalysts) 1-40, 1-30, 1-10, 1-5, 2-40, 2-30, 2-10, 3-40, 3-30 or 3-10. In certain embodiments, the active metal component(s) include one or more of cobalt, nickel, tungsten and molybdenum, and effective concentrations are based on all the mass of active metal components on an oxide basis. In a typical hydrocracking reaction scheme, the main cracking catalyst bed or beds are followed by post treat catalyst to remove mercaptans formed during hydrocracking. Typical supports for post treat catalyst are silica-alumina, zeolites of combination thereof.

Effective catalysts used in embodiments where those possessing hydrocracking and hydrogenation functionality, for instance, second reaction zone 232 or second reaction zone 340, are known. These catalysts, effective for further conversion and also for hydrogenation of refined and partially cracked components from the feedstock, contain one or more active metal components of metals or metal compounds (oxides or sulfides) selected from the Periodic Table of the Elements IUPAC Groups 6, 7, 8, 9 and 10. One or more active metal component(s) are typically deposited or otherwise incorporated on a support, which can be amorphous and/or structured, such as alumina, silica-alumina, silica, titania, titania-silica, titania-silicates, or zeolites. Combinations of active metal components can be composed of different particles/granules containing a single active metal species, or particles containing multiple active species. For example, effective hydrocracking catalysts include one or more of an active metal component selected from the group consisting of cobalt, nickel, tungsten, molybdenum (oxides), incorporated on acidic alumina, silica alumina, zeolite or a combination thereof. In certain embodiments, the catalyst particles have a pore volume in the range of about (cc/gin) 0.15-1.70, 0.15-1.50, 0.30-1.50 or 0.30-1.70; a specific surface area in the range of about ($m^2/g$) 100-900, 100-800, 100-500, 100-450, 180-900, 180-800, 180-500, 180-450, 200-900, 200-800, 200-500 or 200-450; and an average pore diameter of at least about 45, 50, 100, 200, 500 or 1000 angstrom units. The active metal component(s) are incorporated in an effective concentration, for instance, in the range of (wt % based on the mass of the oxides, sulfides or metals relative to the total mass of the catalyst) 0.01-40, 0.01-30, 0.01-10, 0.01-5, 1-40, 1-30, 1-10, 1-5, 2-40, 2-30, 2-10, 3-40, 3-30 or 3-10. In certain embodiments, the active metal component(s) include one or more of cobalt, nickel, tungsten and molybdenum, and effective concentrations are based on all the mass of active metal components on an oxide basis. In embodiments in which one or more upstream reaction zone(s) reduces contaminants such as sulfur and nitrogen, so that hydrogen sulfide and ammonia are minimized in the reaction zone, active metal components effective as hydrogenation catalysts can include one or more noble metals such as platinum, palladium or rhodium, alone or in combination with other active metals such as nickel. Such noble metals can be provided in the range of (wt % based on the mass of the metal relative to the total mass of the catalyst) 0.01-5, 0.01-2, 0.05-5, 0.05-2, 0.1-5, 0.1-2, 0.5-5, or 0.5-2.

In certain embodiments, the catalyst and/or the catalyst support is prepared in accordance with U.S. Pat. No. 9,221,036 and related U.S. Pat. No. 10,081,009 (jointly owned by the owner of the present application), which are incorporated herein by reference in their entireties, includes a modified USY zeolite support having one or more of Ti, Zr and/or Hf substituting the aluminum atoms constituting the zeolite framework thereof.

In embodiments described herein using zeolite-based hydrocracking catalysts, HPNA compounds have relatively greater tendency to accumulate in the recycle stream due to the inability for these larger molecules to diffuse into the catalyst pore structure, particularly at relatively lower hydrogen partial pressure levels in the reactor. For instance, at hydrogen partial pressures less than about 100 bars, HPNA formation is known to reduce catalyst lifecycle to by 30-70% depending upon the feedstock processed and targeted conversion rate. However, according to the process herein, by removing HPNA compounds from the recycle stream, the lifecycle of such zeolite catalyst is increased.

The HPNA separation zones 120, 220 and 320 integrated in hydrocracking systems 100, 200 and 300 described herein, and variations thereto apparent to a person having ordinary skill in the art, are effective for removal of HPNA compounds and/or HPNA precursor compounds from hydrocracker bottoms stream. The hydrocracker bottoms fraction contains HPNA compounds and/or HPNA precursor compounds that were formed in the reaction zones, and are treated in the HPNA separation zone to produce the reduced-H PNA hydrocracked bottoms fraction. In certain embodiments, a major portion, a significant portion, or a substantial portion of HPNA compounds are removed from the hydrocracker bottoms fraction by liquid-liquid extraction using non-polar solvents to separate precipitated HPNA compounds and/or HPNA precursor compounds from the remaining hydrocarbons.

Figure 4:
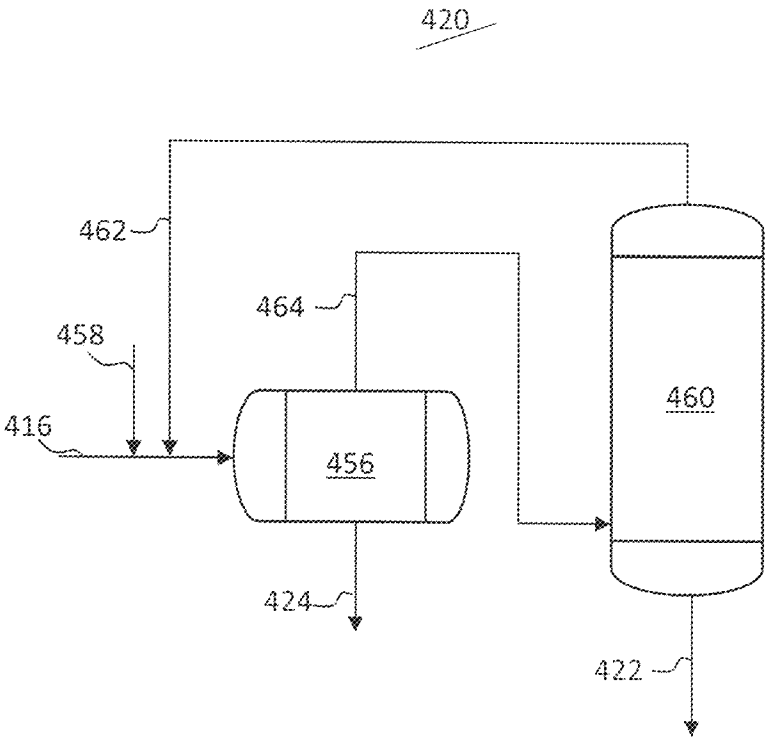
FIGS. 4 and 5 are is a process flow diagrams of embodiments of separation of HPNA compounds from a hydrocracker bottoms fraction, in which removal of HPNA compounds is carried by solvent extraction operations using non-polar solvent in one or more settler vessels.

Referring to FIG. 4, a method for separation of HPNA from a hydrocracked bottoms fraction is shown using solvent extraction based on polarity. A hydrocracked bottoms fraction is contacted with an effective quantity of non-polar solvent under reaction conditions suitable to facilitate precipitation of HPNA compounds and/or HPNA precursor compounds. The feed comprising or consisting of a hydrocracked bottoms fraction 416 (for instance corresponding to all, a substantial portion, a significant portion, or a major portion of streams 116, 216 or 316 above) containing HPNA compounds and other hydrocarbons is subjected to liquid-liquid extraction using non-polar solvent to reject the polar HPNA and HPNA precursor compounds. The HPNA separation zone 420 generally includes a settler 456 and a flash separation zone 460. Settler 456 includes an inlet for receiving the hydrocracked bottoms fraction 416 and solvent, which can be a fresh solvent stream 458, a recycle solvent stream 462, or a combination of these solvent sources. The settler 456 also includes one or more outlets for discharging a soluble phase 464 containing HPNA-reduced hydrocracked bottoms and solvent, and one or more outlets for discharging HPNA compounds as an insoluble precipitate phase 424. The flash separation zone 460 includes an inlet for receiving the soluble phase 464, one or more outlets for discharging a solvent stream 462, and one or more outlets for discharging an HPNA-reduced hydrocracked bottoms fraction 422 (for instance corresponding to streams 122, 222 or 322 above).

The hydrocracked bottoms fraction 416 is admixed with non-polar solvent from one or more sources 458 and/or 462. The resulting mixture is then transferred to the settler 456. By mixing and settling, two phases are formed in the settler 456, a soluble phase 464 containing the non-polar solvent and soluble compounds from the mixture, and the precipitated H PNA phase 424. The temperature of the settler 456 is sufficiently low to recover the soluble phase 464 from the feedstock. For instance, for a system using n-butane, a suitable temperature range is about 60° C. to 150° C. and a suitable pressure range is such that it is higher than the vapor pressure of n-butane at the operating temperature, such as about 15 to 25 bars to maintain the solvent in liquid phase. For example, in a system using n-pentane, a suitable temperature range is about 60° C. to about 180° C. and again a suitable pressure range is such that it is higher than the vapor pressure of n-pentane at the operating temperature, such as about 10 to 25 bars to maintain the solvent in liquid phase. he soluble phase 464 including a majority of solvent and soluble content of the mixture, and is discharged via the outlet of the primary settler 456 and collector pipes (not shown). The precipitated HPNA phase 424 is discharged via one or more outlets located at the bottom of the settler 456. The soluble phase 464 is passed to the flash separation zone 460 to obtain a solvent stream 462 and an HPNA-reduced hydrocracked bottoms fraction 422. Solvent streams 462 can be used as solvent for the settler 456, therefore minimizing the fresh solvent 458 requirement.

Figure 5:
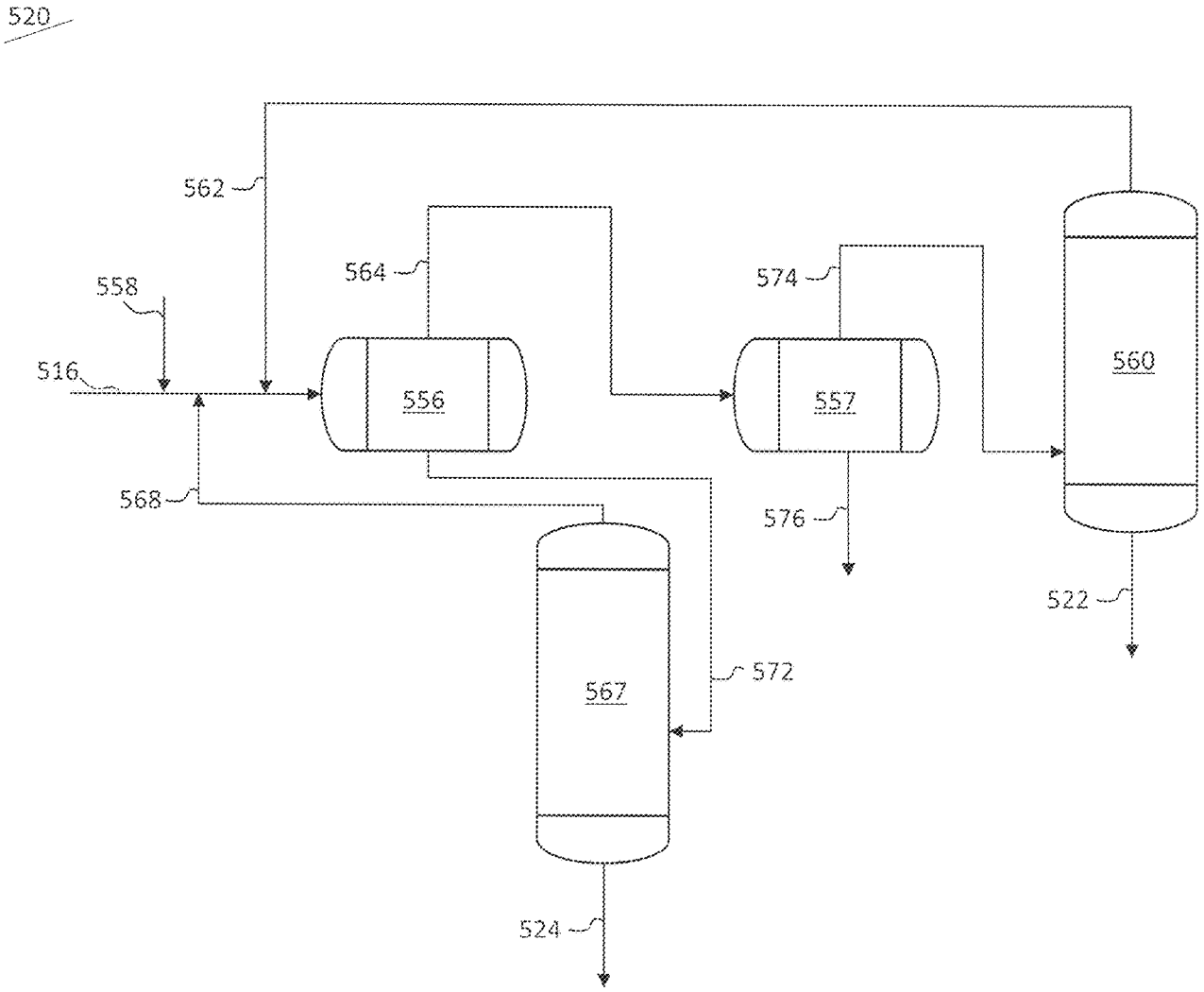

Referring to FIG. 5, another method for separation of HPNA from a hydrocracked bottoms fraction is shown, including a two stage solvent separation process. The feed comprising or consisting of a hydrocracked bottoms fraction 516 (for instance corresponding to all, a substantial portion, a significant portion, or a major portion of streams 116, 216 or 316 above) containing HPNA compounds and other hydrocarbons is subjected to liquid-liquid solvent extraction using non-polar solvent to reject the polar HPNA and HPNA precursor compounds. The HPNA separation zone 520 generally includes a primary settler 556, a secondary settler 557, a first flash separation zone 567, and a second flash separation zone 560. Primary settler 556 includes an inlet for receiving the hydrocracked bottoms fraction 516 and a solvent, which can be a fresh solvent stream 558, a first separation zone recycle solvent stream 568, a second separation zone recycle solvent stream 562, or a combination of these solvent sources. The primary settler 556 also includes one or more outlets for discharging a soluble phase 564 and one or more outlets for discharging HPNA compounds as the insoluble precipitate phase 572. The secondary settler 557 includes an inlet for receiving the soluble phase 564, one or more outlets for discharging a secondary reduced HPNA oil phase 574, and one or more outlets for discharging a secondary HPNA phase 576. The first separation zone 567 includes a vessel having an inlet for receiving primary HPNA phase 572, one or more outlets for discharging a solvent stream 568 and one or more outlets for discharging an HPNA phase 524 (for instance corresponding to streams 124, 224 or 324 above). The second separation zone 560 includes a vessel having an inlet for receiving secondary oil phase 574, one or more outlets for discharging a solvent stream 562, and one or more outlets for discharging an HPNA-reduced hydrocracked bottoms fraction 522 (for instance corresponding to streams 122, 222 or 322 above).

The hydrocracked bottoms fraction 516 is admixed with solvent from one or more sources 558, 568 and 562. The resulting mixture is then transferred to the primary settler 556. By mixing and settling, two phases are formed in the primary settler 556: a primary soluble phase 564 containing the non-polar solvent and soluble compounds from the mixture, and a primary HPNA phase 572. The temperature of the primary settler 556 is sufficiently low to recover the soluble phase 564 from the feedstock. For instance, for a system using n-butane, a suitable temperature range is about 60° C. to 150° C. and a suitable pressure range is such that it is higher than the vapor pressure of n-butane at the operating temperature, such as about 15 to 25 bars to maintain the solvent in liquid phase. In a system using n-pentane, a suitable temperature range is about 60° C. to about 180° C. and again a suitable pressure range is such that it is higher than the vapor pressure of n-pentane at the operating temperature, such as about 10 to 25 bars to maintain the solvent in liquid phase. The temperature in the second settler is usually higher than the one in the first settler. The primary soluble phase 564 including a majority of solvent and oil with a minor amount of HPNA is discharged via the outlet of the primary settler 556 and collector pipes (not shown). The primary HPNA phase 572 is discharged via one or more outlets located at the bottom of the primary settler 556. The primary soluble phase 564 enters into the secondary settler 557 (for example via two tee-type distributors at both ends, not shown) which serves as the final stage for the extraction. A secondary HPNA phase 576 containing a small amount of solvent and oil is discharged from the secondary settler 557 and can optionally be recycled (not shown) to the primary settler 556 for further oil recovery. A secondary soluble phase 574 is obtained and passed to the flash separation zone 560 to obtain a solvent stream 562 and a reduced HPNA recycle oil stream 522. Greater than 90 wt % of the solvent charged to the settlers enters flash separation zone 560, which is dimensioned to permit a rapid and efficient flash separation of solvent from the oil. The primary HPNA phase 572 is conveyed to the flash separation zone 567 for flash separation of a solvent stream 568 and an HPNA phase 524. Solvent streams 562 and 568 can be used as solvent for the primary settler 556, therefore minimizing the fresh solvent 558 requirement.

The solvents used in HPNA separation zones 420, 520 can be suitable non-polar solvents effective to facilitate precipitation of the HPNA and/or HPNA precursor compounds. The non-polar solvent, or solvents, if more than one is employed, preferably have an overall Hildebrand solubility parameter of less than about 8.0 or the complexing solubility parameter of less than 0.5 and a field force parameter of less than 7.5. Suitable non-polar solvents include, for example, saturated aliphatic hydrocarbons such as pentanes, hexanes, heptanes, $C_5$-$C_{11}$ paraffins and/or naphthenes, paraffinic $C_5$-$C_{11}$ naphthas, paraffinic $C_{12}$-$C_{15}$ kerosene, paraffinic $C_{16}$-$C_{20}$ diesel, normal and branched paraffins, mixtures of any of these solvents. In certain embodiments the solvents are $C_5$-$C_7$ paraffins, $C_5$-$C_7$ naphthenes, and $C_5$-$C_{11}$ paraffinic naphthas. In some embodiments, the non-polar solvent is selected from a paraffinic solvent having the formula $C_nH_{2n+2}$ (where n=3 to 10). Certain non-polar solvents are paraffinic solvents such as those having between 3 and 7 carbon atoms, include pure liquid hydrocarbons such as propane, butanes and pentanes, as well as their mixtures; these are known and commonly used in, for example, solvent deasphalting processes. In certain embodiments, all, a substantial portion, a significant portion, or a major portion of the fresh solvent 458, 558 used is obtained from a light naphtha fraction derived from the distillate fraction 114, 214 or 314, from a distillation unit upstream of the hydrocracker zone, or from another source. The operating conditions for the settler vessels include a temperature at or below the critical point of the non-polar solvent; a solvent-to-oil ratio (V/V) in the range of from about 2:1-50:1, 2:1-30:1, 2:1-15:1, 5:1-50:1, 5:1-30:1 or 5:1-15:1; and a pressure in a range that is effective to maintain the solvent/feed mixture in the liquid state in the vessel(s).

The essentially solvent-free oil stream is optionally steam stripped (not shown) to remove solvent and recycled in a single-stage or series-flow hydrocracker system, or conveyed to a second reactor in a two-stage system, as described above with respect to FIGS. 1-3.

Example 1

In one example, a solvent-oil ratio of 2:1 (mass/mass) was used. A 5.0 gram sample of hydrocracker bottoms recycle, containing 97 ppmw of sulfur and less than 1 ppmw of nitrogen, was mixed with 10 ml of pentane and shaken in an ultrasonic shaker for 15 minutes. The mixture was covered and left overnight to settle and precipitate the disassociated HPNA from the solution. The mixture was filtered in a vacuum filtration device using a 0.45 μm filter to recover the HPNA precipitated. The HPNA recovered and reduced HPNA recycle oil were analyzed using FT-Mass Spectrometer.

Figure 6A:
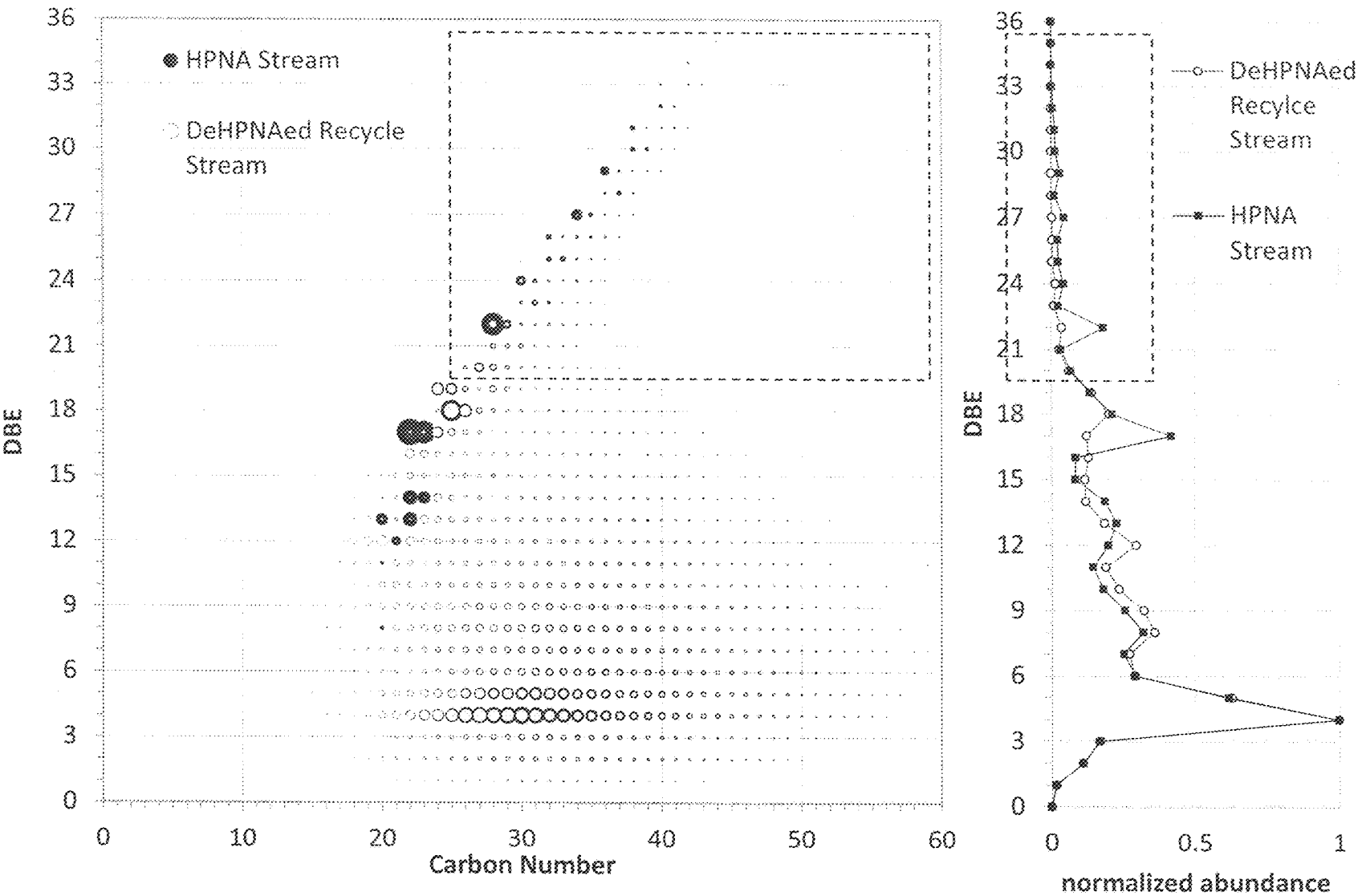
FIGS. 6A and 6B are plots of the DBE and peak intensities as a function of carbon number for the HPNA molecules and the reduced HPNA fraction (left side) and the summed normalized abundance for each DBE series (right side)

FIG. 6A illustrates the DBE and peak intensities as a function of carbon number for the HPNA molecules, in the HPNA fraction and reduced HPNA fraction streams (left side), and the normalized abundance per DBE series, including all components of any carbon number that share a DBE value (right side). The peak intensities are depicted by the area of the bubble shown. The summed peak intensities of each DBE series are shown as normalized abundance. The rectangular boxes shown in FIG. 6A are the area in the graphs in which the majority of HPNA molecules would be located. As seen, a substantial amount of the HPNA molecules were removed from the recycle stream in the process of the present invention. FT-MS abundance data clearly shown that stream with reduced HPNA compounds contains only about 45% of the HPNA.

Example 2

In another example, a solvent-oil ratio of 40:1 (mass/mass) was used. A 2.0 gram sample of hydrocracker bottoms recycle, containing 97 ppmw of sulfur and less than 1 ppmw of nitrogen, was mixed with 80 ml of pentane and shaken in an ultrasonic shaker for 15 minutes. The mixture was covered and left overnight to settle and precipitate the disassociated HPNA from the solution. The mixture was filtered in a vacuum filtration device using a 0.45 μm filter to recover the HPNA precipitated. The HPNA recovered and reduced HPNA recycle oil were analyzed using FT-Mass Spectrometer.

Figure 6B:
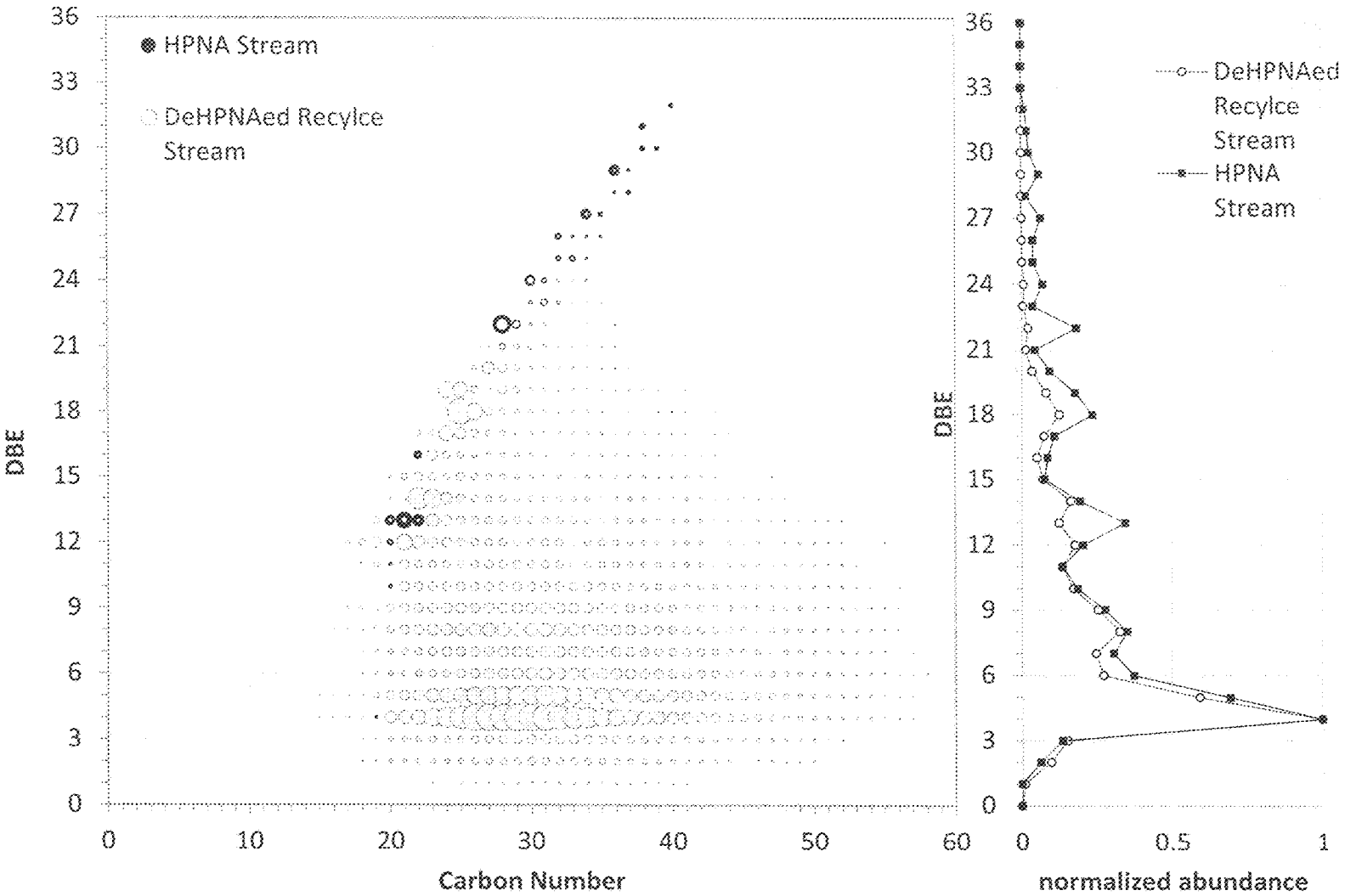

FIG. 6B illustrates the DBE and peak intensities as a function of carbon number for the HPNA molecules, in the HPNA fraction and reduced HPNA fraction streams (left side), and the normalized abundance per DBE series, including all components of any carbon number that share a DBE value (right side). The peak intensities are depicted by the area of the bubble shown. The summed peak intensities of each DBE series are shown as normalized abundance. The rectangular boxes shown in FIG. 6B are the areas in the graphs in which the majority of HPNA molecules would be located. As seen, a substantial amount of the HPNA molecules were removed from the recycle stream in the process of the present invention. FT-MS abundance data clearly shown that stream with reduced HPNA compounds contains only about 20% of the HPNA.

Example 3

Figure 7:
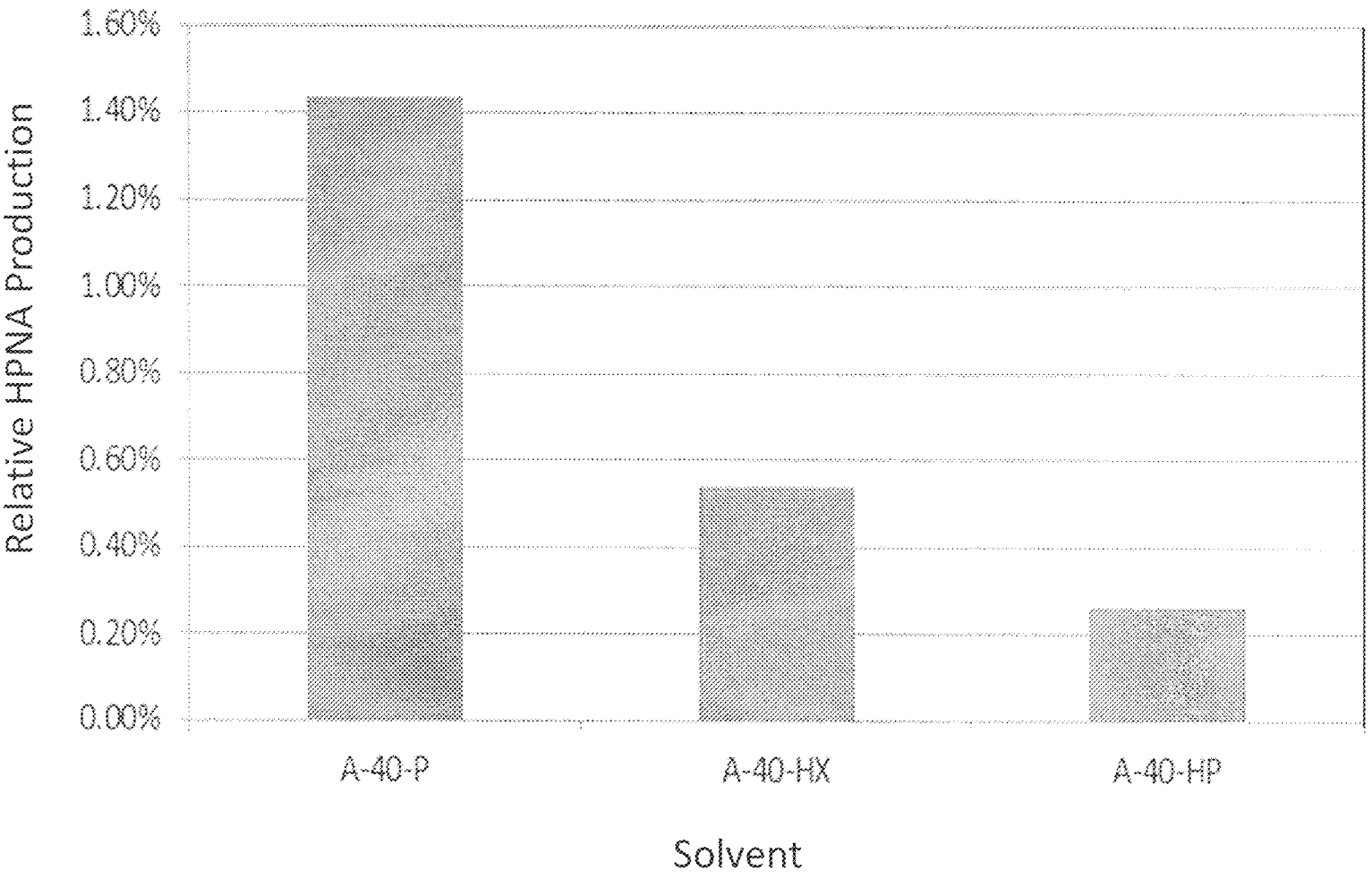
FIG. 7 is a graph of the relative amount of HPNA recovered using various solvents.

Example 2 was repeated with both hexane and heptane as solvents to determine the effect of each solvent on the HPNA separation. It was found that the higher the carbon number of the solvent, the lower the amount of the HPNA precipitated. FIG. 7 shows the relative HPNA recovered based on the FT-MS abundances. For example, pentane with five carbon number resulted in precipitation of 1.4% of HPNAs, whereas heptane with a carbon number of seven resulted in 0.25% of HPNAs being separated.

This result of the higher the carbon number of the solvent, the lower the amount of the HPNA precipitated is further demonstrated in Examples 4-6.

Example 4

1.0216 g of a hydrocracker recycle stream, containing 97 ppmw of sulfur and less than 1 ppmw of nitrogen was mixed with 2 ml of pentane and shaken in an ultrasonic shaker for 15 minutes. The mixture was covered and left overnight to settle and precipitate the disassociated HPNA from the solution. The mixture was filtered in a vacuum filtration device using 0.45 μm filter to recover the HPNA precipitated. This example yielded 1.75 W % of HPNA and the remaining recycle oil was recycled back to the hydrocracking unit.

Example 5

1.015 g of hydrocracker recycle stream, containing 97 ppmw of sulfur and less than 1 ppmw of nitrogen was mixed with 2 ml of hexane and shaken in an ultrasonic shaker for 15 minutes. The mixture was covered and left overnight to settle and precipitate the disassociated HPNA from the solution. The mixture was filtered in a vacuum filtration device using 0.45 μm filter to recover the HPNA precipitated. This example yielded 1.53 W % of HPNA and the remaining recycle oil was recycled back to the hydrocracking unit.

Example 6

1.0695 g of hydrocracker recycle stream, containing 97 ppmw of sulfur and less than 1 ppmw of nitrogen was mixed with 2 ml of heptane and shaken in an ultrasonic shaker for 15 minutes. The mixture was covered and left overnight to settle and precipitate the disassociated HPNA from the solution. The mixture was filtered in a vacuum filtration device using 0.45 μm filter to recover the HPNA precipitated. This example yielded 1.10 W % of HPNA and the remaining recycle oil was recycled back to the hydrocracking unit.

While not shown, the skilled artisan will understand that additional equipment, including exchangers, furnaces, pumps, columns, and compressors to feed the reactors, maintain proper operating conditions, and to separate reaction products, are all part of the systems described.

The method and system of the present invention have been described above and in the attached drawings; however, modifications will be apparent to those of ordinary skill in the art and the scope of protection for the invention is to be defined by the claims that follow.

The invention claimed is:

1. A two stage hydrocracking process integrating removal of heavy poly nuclear aromatic (HPNA) compounds that are formed during hydrocracking, the process comprising:

subjecting a hydrocarbon feed comprising one or more of vacuum gas oil, demetallized oil or deasphalted oil to a first hydrocracking stage to produce a first hydrocracked effluent having converted, partially converted and unconverted hydrocarbons, and a reduced content of organosulfur and organonitrogen compounds relative to the hydrocarbon feed, wherein HPNA compounds are formed during the first hydrocracking stage;

fractionating the first hydrocracked effluent to recover one or more hydrocracked product fractions and a hydrocracked bottoms fraction containing HPNA compounds formed during the first hydrocracking stage;

contacting the hydrocracked bottoms fraction and an additional feed with an effective quantity of a non-polar solvent under conditions effective to form a precipitated phase containing precipitated HPNA compounds and a soluble phase containing non-polar solvent and soluble compounds from the hydrocracked bottoms fraction, wherein said conditions include a solvent-to-oil ratio (V/V) in the range of from about 2:1-50:1, at a temperature at or below the critical point of the non-polar solvent, and a at pressure in a range that is effective to maintain the solvent/feed mixture in liquid phase, and separating into an HPNA-reduced hydrocracked bottoms portion from the soluble phase and the precipitated phase, wherein non-polar solvent is selected from the group consisting of saturated aliphatic hydrocarbons, C5-C11 paraffins and/or naphthenes, paraffinic C5-C11 naphthas, paraffinic C12-C15 kerosene, paraffinic C16-C20 diesel, normal and branched paraffins, and mixtures including at least one of the foregoing non-polar solvents;

passing all or a portion of the HPNA-reduced hydrocracked bottoms portion to a second hydrocracking stage to produce a second hydrocracked effluent; and discharging the precipitated phase containing precipitated HPNA compounds, wherein the additional feed is selected from the group consisting of one or more of straight run vacuum gas oil, treated vacuum gas oil, demetallized oil from solvent demetallizing operations, deasphalted oil from solvent deasphalting operations, coker gas oils from coker operations, cycle oils from fluid catalytic cracking operations including heavy cycle oil, and visbroken oils from visbreaking operations, and wherein the additional feed has a boiling point range within about 350-800° C.

2. The process as in claim 1, wherein non-polar solvent is selected from the group consisting of C5-C7 paraffins, C5-C7 naphthenes, and C5-C11 paraffinic naphthas.

3. The process as in claim 1, further comprising separating non-polar solvent from the soluble phase and recovering the HPNA-reduced hydrocracked bottoms portion, and optionally recycling non-polar solvent to the step of contacting the hydrocracked bottoms fraction.

4. The process as in claim 1, wherein the contacting comprises:

admixing the hydrocracked bottoms fraction and the non-polar solvent;

transferring the mixture of the hydrocracked bottoms fraction and the non-polar solvent to a settler to form the soluble phase and the precipitated phase;

discharging the precipitated phase as the precipitated HPNA portion;

separating non-polar solvent from the soluble phase and recovering the HPNA-reduced hydrocracked bottoms portion; and optionally recycling non-polar solvent to the step of contacting the hydrocracked bottoms fraction.

5. The process as in claim 1, wherein the contacting comprises:

admixing the hydrocracked bottoms fraction and the non-polar solvent;

transferring the mixture of the hydrocracked bottoms fraction and the non-polar solvent to a primary settler to form a primary soluble phase and a primary precipitated phase;

passing the primary soluble phase to a secondary settler to form a secondary soluble phase and a secondary precipitated phase;

separating non-polar solvent from the primary HPNA phase and discharging the secondary precipitated phase as the precipitated HPNA portion;

separating non-polar solvent from the secondary soluble phase and discharging the HPNA-reduced hydrocracked bottoms portion; and optionally recycling non-polar solvent to the step of contacting the hydrocracked bottoms fraction.

6. The process as in claim 1, wherein the second hydrocracked effluent is fractionated with the first hydrocracked effluent.

7. The process as in claim 1, wherein contacting the hydrocracked bottoms fraction with an effective quantity of a non-polar solvent promotes precipitation of HPNA compounds that are compounds having fused polycyclic aromatic compounds having double bond equivalence (DBE) values of 19 and above, or that are compounds having 7 or more rings.

8. The process as in claim 3, wherein at least a major portion of the non-polar solvent is derived from light naphtha obtained from the one or more hydrocracked product fractions.

9. A hydrocracking process integrating removal of heavy poly nuclear aromatic (HPNA) compounds that are formed during hydrocracking, the process comprising:

subjecting a hydrocarbon feed comprising one or more of vacuum gas oil, demetallized oil or deasphalted oil to one or more hydrocracking stages to produce a hydrocracked effluent having converted, partially converted and unconverted hydrocarbons, and a reduced content of organosulfur and organonitrogen compounds relative to the hydrocarbon feed, wherein HPNA compounds are formed during the first hydrocracking stage;

fractionating the hydrocracked effluent to recover one or more hydrocracked product fractions and a hydrocracked bottoms fraction containing HPNA compounds formed during the first hydrocracking stage;

contacting the hydrocracked bottoms fraction and an additional feed with an effective quantity of a non-polar solvent under conditions effective to form a precipitated phase containing precipitated HPNA compounds and a soluble phase containing non-polar solvent and soluble compounds from the hydrocracked bottoms fraction, wherein said conditions include a solvent-to-oil ratio (V/V) in the range of from about 2:1-50:1, at a temperature at or below the critical point of the non-polar solvent, and a at pressure in a range that is effective to maintain the solvent/feed mixture in liquid phase, and separating into an HPNA-reduced hydrocracked bottoms portion from the soluble phase and the precipitated phase, wherein non-polar solvent is selected from the group consisting of saturated aliphatic hydrocarbons, C5-C11 paraffins and/or naphthenes, paraffinic C5-C11 naphthas, paraffinic C12-C15 kerosene, paraffinic C16-C20 diesel, normal and branched paraffins, and mixtures including at least one of the foregoing non-polar solvents;

recycling all or a portion of the HPNA-reduced hydrocracked bottoms portion to at least one of the one or more hydrocracking stages; and discharging the precipitated phase containing precipitated HPNA compounds wherein the additional feed is selected from the group consisting of one or more of straight run vacuum gas oil, treated vacuum gas oil, demetallized oil from solvent demetallizing operations, deasphalted oil from solvent deasphalting operations, coker gas oils from coker operations, cycle oils from fluid catalytic cracking operations including heavy cycle oil, and visbroken oils from visbreaking operations, and wherein the additional feed has a boiling point range within about 350-800° C.

10. The process as in claim 9, wherein non-polar solvent is selected from the group consisting of C5-C7 paraffins, C5-C7 naphthenes, and C5-C11 paraffinic naphthas.

11. The process as in claim 9, further comprising separating non-polar solvent from the soluble phase and recovering the HPNA-reduced hydrocracked bottoms portion, and optionally recycling non-polar solvent to the step of contacting the hydrocracked bottoms fraction.

12. The process as in claim 9, wherein the contacting comprises:

admixing the hydrocracked bottoms fraction and the non-polar solvent;

transferring the mixture of the hydrocracked bottoms fraction and the non-polar solvent to a settler to form the soluble phase and the precipitated phase;

discharging the precipitated phase as the precipitated HPNA portion;

separating non-polar solvent from the soluble phase and recovering the HPNA-reduced hydrocracked bottoms portion; and optionally recycling non-polar solvent to the step of contacting the hydrocracked bottoms fraction.

13. The process as in claim 9, wherein the contacting comprises:

admixing the hydrocracked bottoms fraction and the non-polar solvent;

transferring the mixture of the hydrocracked bottoms fraction and the non-polar solvent to a primary settler to form a primary soluble phase and a primary precipitated phase;

passing the primary soluble phase to a secondary settler to form a secondary soluble phase and a secondary precipitated phase;

separating non-polar solvent from the primary HPNA phase and discharging the secondary precipitated phase as the precipitated HPNA portion;

separating non-polar solvent from the secondary soluble phase and discharging the HPNA-reduced hydrocracked bottoms portion; and optionally recycling non-polar solvent to the step of contacting the hydrocracked bottoms fraction.

14. The process as in claim 11, wherein at least a major portion of the non-polar solvent is derived from light naphtha obtained from the one or more hydrocracked product fractions.

15. The process as in claim 9, wherein contacting the hydrocracked bottoms fraction with an effective quantity of a non-polar solvent promotes precipitation of HPNA compounds that are compounds having fused polycyclic aromatic compounds having double bond equivalence (DBE) values of 19 and above, or that are compounds having 7 or more rings.

* * * * *